US010442056B2

(12) United States Patent
Namiki et al.

(10) Patent No.: US 10,442,056 B2
(45) Date of Patent: Oct. 15, 2019

(54) SUBSTRATE HOLDING APPARATUS AND POLISHING APPARATUS

(71) Applicant: EBARA CORPORATION, Tokyo (JP)

(72) Inventors: Keisuke Namiki, Tokyo (JP); Hozumi Yasuda, Tokyo (JP); Osamu Nabeya, Tokyo (JP); Makoto Fukushima, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 817 days.

(21) Appl. No.: 13/929,295

(22) Filed: Jun. 27, 2013

(65) Prior Publication Data

US 2014/0004779 A1 Jan. 2, 2014

(30) Foreign Application Priority Data

Jun. 29, 2012 (JP) ..... 2012-146627

(51) Int. Cl.
*B24B 37/32* (2012.01)
*B24B 37/30* (2012.01)

(52) U.S. Cl.
CPC ..... *B24B 37/32* (2013.01); *B24B 37/30* (2013.01)

(58) Field of Classification Search
None
See application file for complete search history.

(56) References Cited

U.S. PATENT DOCUMENTS

| | | | | |
|---|---|---|---|---|
| 6,769,973 | B2 * | 8/2004 | Boo | B24B 41/061 340/680 |
| 7,044,832 | B2 | 5/2006 | Yilmaz et al. | |
| 7,198,561 | B2 | 4/2007 | Chen et al. | |
| 7,402,098 | B2 * | 7/2008 | Severson | B24B 37/30 451/288 |
| 7,654,888 | B2 | 2/2010 | Zuniga et al. | |
| 8,070,560 | B2 | 12/2011 | Yasuda | |
| 2005/0107015 | A1 * | 5/2005 | Togawa | B24B 37/30 451/285 |
| 2008/0102732 | A1 | 5/2008 | Severson et al. | |
| 2013/0136884 | A1 | 5/2013 | Yasuda | |

FOREIGN PATENT DOCUMENTS

| | | |
|---|---|---|
| JP | 2002-198339 A | 7/2002 |
| JP | 2004-297029 A | 10/2004 |
| JP | 2005-014128 A | 1/2005 |

(Continued)

*Primary Examiner* — Brian D Keller
(74) *Attorney, Agent, or Firm* — Baker & Hostetler LLP

(57) ABSTRACT

A substrate holding apparatus is used for holding a substrate such as a semiconductor wafer in a polishing apparatus for polishing and planarizing the substrate. The substrate holding apparatus includes an elastic membrane, a top ring body for holding the elastic membrane, and a plurality of pressure chambers partitioned by at least one partition wall of the elastic membrane. The substrate is held by a lower surface of the elastic membrane and pressed against the polishing surface with a fluid pressure by supplying a pressurized fluid to the pressure chambers. The substrate holding apparatus further include a stopper configured to limit the inflation of the elastic membrane by being brought into contact with a part of the partition wall of the elastic membrane or an extending member extending from a rear surface of the elastic membrane whose surface serves as a substrate holding surface.

29 Claims, 15 Drawing Sheets

(56) References Cited

FOREIGN PATENT DOCUMENTS

| | | |
|---|---|---|
| JP | 2005-123485 | 5/2005 |
| JP | 2008-066761 A | 3/2008 |
| JP | 2010-046756 | 3/2010 |
| JP | 2010-508165 A | 3/2010 |
| WO | WO 2005/005101 A1 | 1/2005 |

* cited by examiner

SUBSTRATE HOLDING APPARATUS AND POLISHING APPARATUS

CROSS REFERENCE TO RELATED APPLICATIONS

This document claims priority to Japanese Application Number 2012-146627, filed Jun. 29, 2012, the entire contents of which are hereby incorporated by reference.

BACKGROUND OF THE INVENTION

Field of the Invention

The present invention relates to a substrate holding apparatus for holding a substrate to be polished and pressing the substrate against a polishing pad (polishing surface), and more particularly to a substrate holding apparatus for holding a substrate such as a semiconductor wafer in a polishing apparatus for polishing and planarizing the substrate. Further, the present invention relates to a polishing apparatus having such substrate holding apparatus.

Description of the Related Art

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). In the chemical mechanical polishing, while a polishing liquid containing abrasive particles such as silica ($SiO_2$) therein is supplied onto a polishing surface such as a polishing pad, a substrate such as a semiconductor wafer is brought into sliding contact with the polishing surface and polished using the polishing apparatus.

The polishing apparatus which performs the above-mentioned CMP process includes a polishing table having a polishing surface formed by a polishing pad, and a substrate holding apparatus, which is referred to as a top ring or a polishing head, for holding a substrate such as a semiconductor wafer. When the substrate is polished with such a polishing apparatus, the substrate is held and pressed against the polishing surface under a predetermined pressure by the substrate holding apparatus. At this time, the polishing table and the substrate holding apparatus are moved relative to each other to bring the substrate into sliding contact with the polishing surface, so that the surface of the substrate is polished to a flat mirror finish.

If a relative pressing force produced between the substrate and the polishing surface of the polishing pad is not uniform over the entire surface of the substrate, then the substrate is insufficiently or excessively polished depending on the pressing force applied to each area of the substrate. Therefore, it has been attempted that a holding surface of the substrate holding apparatus is formed by an elastic membrane of an elastic material such as rubber, and a plurality of pressure chambers to which a pressurized fluid is supplied are formed at the reverse side of the elastic membrane and a fluid pressure such as air pressure is applied to the pressure chambers to uniform the pressing force applied to the substrate over the entire surface of the substrate.

If transferring of the substrate to be polished to the substrate holding apparatus and receiving of the polished substrate from the substrate holding apparatus are conducted directly by a transportation apparatus such as a robot, there is a risk of transfer error caused by variation in transfer accuracy of the substrate holding apparatus and the transportation apparatus. Therefore, a substrate transfer unit, which is referred to as a pusher, is provided at a position where the substrate is transferred to the substrate holding apparatus or a position where the substrate is transferred from the substrate holding apparatus. The substrate transfer unit is an apparatus which has a function for temporarily placing the substrate transferred by the transportation apparatus such as a robot thereon and then lifting and transferring the substrate to the substrate holding apparatus such as a top ring which has moved above the substrate transfer unit, and a function for transferring the substrate received from the substrate holding apparatus to the transportation apparatus such as a robot.

When the substrate holding apparatus such as a top ring or a polishing head transfers the substrate such as a semiconductor wafer to the pusher (substrate transfer unit), a pressurized fluid (gas, liquid, or mixed fluid of gas and liquid) is supplied into a fluid passage provided in the top ring to push the substrate out of the top ring, thus releasing the substrate from the top ring. At this time, a certain gap is provided between the top ring and the pusher, and thus the substrate falls by a distance of the gap when it is released from the top ring, and the fallen substrate is received by the pusher.

A release nozzle disclosed in Japanese laid-open patent publication No. 2005-123485 or the like, having been used to reduce stress applied to the substrate when the substrate is released from the top ring, can be thought to be alternative. The release nozzle serves as an assisting mechanism for assisting the release of the substrate from the top ring by ejecting a pressurized fluid between the rear surface of the substrate and the membrane. In this case, the substrate is pushed out downwardly from the bottom surface of a retainer ring to remove the peripheral portion of the substrate from the membrane, and then the pressurized fluid is ejected between the peripheral portion of the substrate and the membrane. Therefore, when the substrate is released from the top ring, it is necessary to inflate the membrane by pressurizing the membrane, as disclosed in the paragraph [0084] of Japanese laid-open patent publication No. 2005-123485. The release nozzle is also disclosed in U.S. Pat. No. 7,044,832. As disclosed in this U.S. patent publication, when the substrate is released, a bladder is inflated (pressurized), and then a shower is sprayed in a state in which the edge portion of the substrate is separated from the bladder (see the 6th to 15th lines of the column 10 and FIG. 2A). Specifically, in both of the above publications, the membrane is inflated to separate the edge portion of the substrate from the membrane, and a shower is sprayed into the gap. However, when the membrane in these publications is pressurized and inflated as suggested, locally varied downforce is applied to the substrate. Accordingly, stress tends to be applied to the substrate locally in accordance with inflation of the membrane, and fine interconnections formed on the substrate are broken or the substrate itself is damaged at the worst.

In contrast thereto, as a method for preventing the membrane from being inflated excessively when the substrate is released from the top ring, Japanese laid-open patent publication No. 2010-46756 discloses that at least one of plural pressure chambers is pressurized and at least one of the plural pressure chambers is depressurized to create a vacuum therein when the substrate is released from the top ring. However, it takes time to create a vacuum in the pressure chamber, resulting in poor responsiveness. Accordingly, it takes time to release (remove) the substrate. Further, when the pressure chamber is depressurized to create a vacuum therein, a local area of the substrate is pulled to increase the amount of deformation of the substrate.

SUMMARY OF THE INVENTION

The present invention has been made in view of the above drawbacks. It is therefore an object of the present invention to provide a substrate holding apparatus and a polishing apparatus which can prevent an elastic membrane (membrane) from being inflated in excess of a certain amount when the substrate is removed from a top ring by pressurizing the membrane, to suppress deformation of the substrate and reduce stress applied to the substrate, thereby preventing generation of a defect of the substrate or damage of the substrate, and releasing (removing) the substrate from the top ring in a safe manner.

In order to achieve the above object, according to one aspect of the present invention, there is provided a substrate holding apparatus for holding a substrate to be polished and pressing the substrate against a polishing surface, comprising; an elastic membrane; a top ring body for holding the elastic membrane; a plurality of pressure chambers partitioned by at least one partition wall of the elastic membrane between the elastic membrane and a lower surface of the top ring body, the substrate being held by a lower surface of the elastic membrane and being pressed against the polishing surface with a fluid pressure by supplying a pressurized fluid to the plurality of pressure chambers; and a stopper configured to limit the inflation of the elastic membrane by being brought into contact with a part of the partition wall of the elastic membrane or an extending member extending from a rear surface of the elastic membrane whose surface serves as a substrate holding surface, when the pressurized fluid is supplied to at least one of the pressure chambers in a state that the substrate held by the elastic membrane is not brought into contact with the polishing surface.

According to the present invention, when the substrate is released (removed) from the substrate holding apparatus, downward pressure is applied to the elastic membrane to inflate the elastic membrane by supplying the pressurized fluid to the at lease one pressure chamber after separating the substrate from the polishing surface. At this time, the part of the partition wall of the elastic membrane or the extending member extending from the rear surface of the elastic membrane whose surface serves as the substrate support is brought into contact with the stopper. Therefore, the amount of inflation of the elastic membrane is limited to suppress deformation of the substrate and reduce stress applied to the substrate during substrate release.

In a preferred aspect of the present invention, the stopper is disposed below the part of the partition wall or the extending member.

In a preferred aspect of the present invention, a predetermined clearance is formed between the stopper, and the part of the partition wall or the extending member, when the substrate is brought into contact with the polishing surface.

According to the present invention, the predetermined clearance is formed between the stopper, and the part of the partition wall or the extending member, when the substrate is brought into contact with the polishing surface. Therefore, the substrate holding surface of the elastic membrane can follow the substrate during polishing, even if the distance from the mounting position of the partition wall of the elastic membrane to the polishing surface (polishing pad) varies in the case where the thickness of consumable parts such as a polishing pad or a retainer ring varies, or the polishing parameters are changed.

In a preferred aspect of the present invention, the predetermined clearance is in the range of 0.5 to 3.0 mm.

In a preferred aspect of the present invention, the part of the partition wall comprises a horizontal portion of the partition wall.

According to the present invention, the partition wall of the elastic membrane comprises an inclined portion extending obliquely upward from the rear surface of the elastic membrane whose surface serves as a substrate holding surface, a horizontal portion extending horizontally from the inclined portion, and a fixing portion extending vertically from the horizontal portion to fix the partition wall to the top ring body (carrier). When the substrate is released, one pressure chamber is pressurized to apply a downward pressure to the elastic membrane. The angle between the horizontal portion and the vertical fixing portion of the partition wall is widened, and the horizontal portion is inclined downwardly. Accordingly, the partition wall is moved in a vertical direction. At this time, the inclination of the horizontal portion of the partition wall is limited by the stopper so that the range of vertical movement of the partition wall is limited and the amount of inflation of the elastic membrane is limited. Therefore, deformation of the substrate can be suppressed and the stress applied to the substrate can be reduced during substrate release.

In a preferred aspect of the present invention, the stopper comprises a horizontal portion extending horizontally at a lower part of the top ring body.

In a preferred aspect of the present invention, the horizontal portion of the stopper is substantially the same length as the horizontal portion of the partition wall.

According to the present invention, since the stopper having the length which is substantially the same as the whole length of the horizontal portion of the partition wall is disposed below the horizontal portion of the partition wall, the range of vertical movement of the partition wall is limited effectively, and the amount of inflation of the elastic membrane is limited when the elastic membrane is pressurized, in such a state that the substrate-pressing-surface of the elastic membrane for pressing the substrate is freely expandable as in the case of removal of the substrate.

In a preferred aspect of the present invention, a tip corner of the stopper is chamfered.

According to the present invention, since the tip corner of the stopper is chamfered, the elastic membrane is prevented from being damaged by the tip corner of the stopper.

In a preferred aspect of the present invention, the extending member has a horizontal portion on its upper part, the horizontal portion of the extending member being configured to be brought into contact with the stopper.

In a preferred aspect of the present invention, the extending member extending from the rear surface of the substrate holding surface of the elastic membrane comprises an annular rib or a plurality of support members.

In a preferred aspect of the present invention, the extending member passes through the top ring body and extends upward, and the stopper is formed on an upper surface of the top ring body.

In a preferred aspect of the present invention, the stopper is configured to be vertically movable by a vertical movement mechanism.

According to the present invention, during substrate polishing, the stopper is lowered to keep the clearance ranging from 0.5 to 3.0 mm between the stopper, and the partition wall of the elastic membrane or the extending member. During substrate release (removal), the stopper is lifted by actuating the vertical movement mechanism, thereby further limiting the range of vertical movement of the partition wall or the extending member. According to the present invention, the range of vertical movement of the partition wall of the elastic membrane during substrate release is further limited as compared to the case where the stopper is fixed, and the amount of inflation of the elastic membrane is further limited. Therefore, deformation of the substrate can be suppressed and the stress applied to the substrate can be reduced dramatically during substrate release.

In a preferred aspect of the present invention, a surface treatment is applied to at least one of the stopper, and the partition wall or the extending member.

According to the present invention, the surface treatment such as fluorine coating is applied to at least one of the surfaces of the stopper, and the partition wall or the extending member. In the case where the stopper, and the partition wall or the extending member stick together, tension is applied to the partition wall, i.e. the vertical movement of the partition wall is hindered during polishing of the substrate. Thus, the pressing force for pressing the substrate against the polishing pad becomes non-uniform at the area where the vertical movement of the partition wall is hindered. By application of the surface treatment to at least one of the surfaces of the stopper, and the partition wall or the extending member, the stopper and the partition wall (or the extending member) are prevented from sticking together.

In a preferred aspect of the present invention, at least one projection is formed on the rear surface of the substrate holding surface of the elastic membrane.

According to the present invention, the rear surface of the elastic membrane has an increased rigidity by the at least one projection, thereby suppressing the amount of inflation of the pressure chamber during substrate release.

In a preferred aspect of the present invention, an opening for ejecting the pressurized fluid toward the substrate, is formed in the elastic membrane for defining the at least one pressure chamber.

According to the present invention, the pressurized fluid supplied to the pressure chamber is ejected through the opening formed in the elastic membrane and presses the substrate downward. Therefore, the substrate can be reliably removed from the elastic membrane.

In a preferred aspect of the present invention, the pressurized fluid is supplied to the at least one pressure chamber in a state that the substrate held by the elastic membrane is not brought into contact with the polishing surface when the substrate is removed from the elastic membrane.

According to another aspect of the present invention, there is provided a polishing apparatus for polishing a substrate, comprising: a polishing table having a polishing surface; a substrate holding apparatus according to claim 1; and a substrate transfer unit configured to transfer the substrate between the substrate holding apparatus and the substrate transfer unit.

According to the present invention, when the substrate is removed from the top ring by pressurizing the elastic membrane (membrane), the elastic membrane is prevented from being inflated in excess of a certain amount to suppress deformation of the substrate and reduce stress applied to the substrate. Thus, generation of a defect of the substrate or damage of the substrate can be prevented, and releasing (removing) of the substrate from the top ring can be performed in a safe manner.

DETAILED DESCRIPTION OF THE PREFERRED EMBODIMENTS

Figure 1:
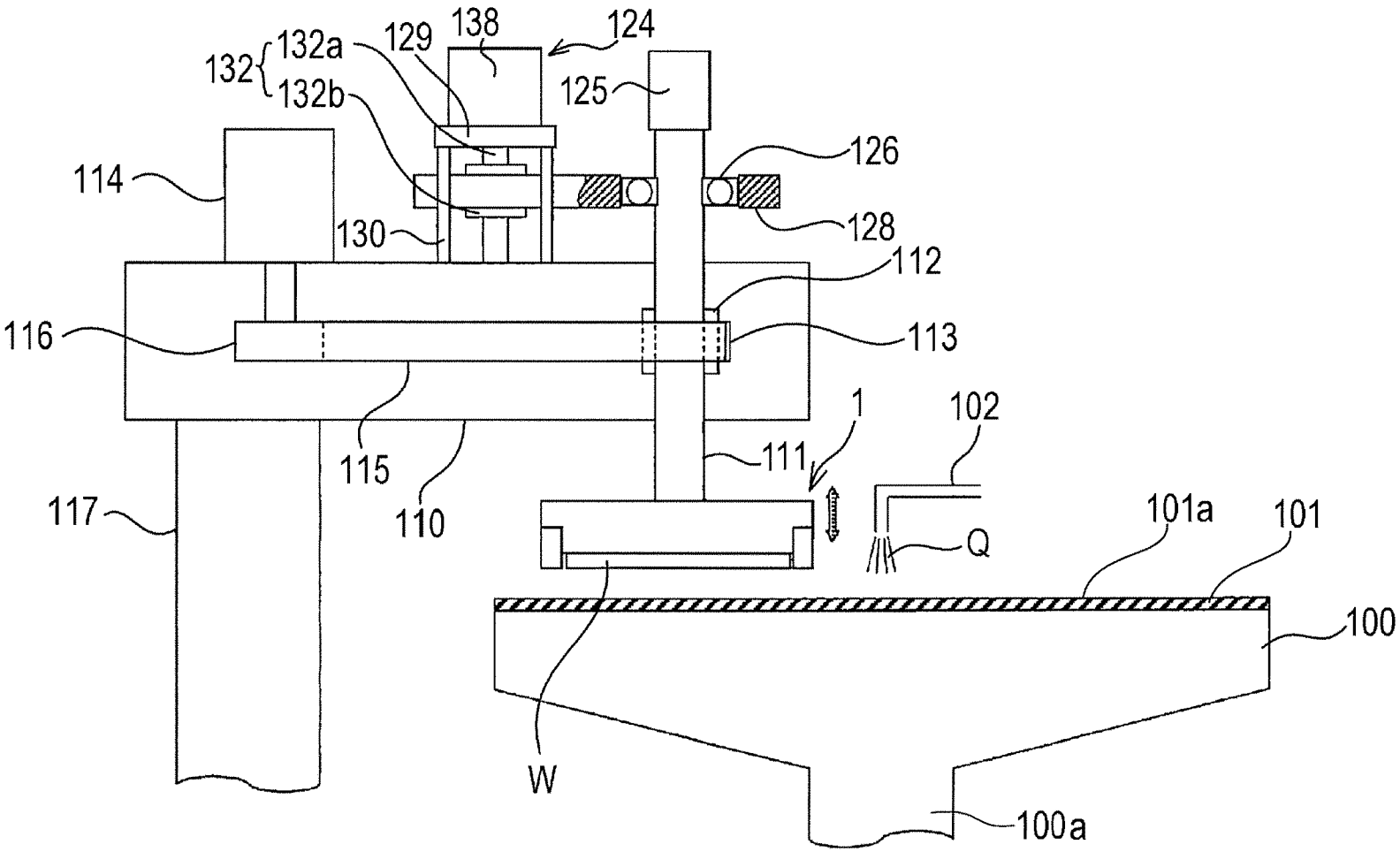
FIG. 1 is a schematic view showing an entire structure of a polishing apparatus according to the present invention.

A polishing apparatus according to embodiments of the present invention will be described below with reference to FIGS. 1 through 20. Like or corresponding structural elements are denoted by like or corresponding reference numerals in FIGS. 1 through 20 and will not be described below repetitively.

FIG. 1 is a schematic view showing an entire structure of a polishing apparatus according to the present invention. As shown in FIG. 1, the polishing apparatus comprises a polishing table 100, and a top ring 1 constituting a polishing head for holding a substrate such as a semiconductor wafer as an object to be polished and pressing the substrate against a polishing surface on the polishing table.

The polishing table 100 is coupled via a table shaft 100*a* to a motor (not shown) disposed below the polishing table 100. Thus, the polishing table 100 is rotatable about the table shaft 100*a*. A polishing pad 101 is attached to an upper surface of the polishing table 100. An upper surface 101*a* of the polishing pad 101 constitutes a polishing surface configured to polish the substrate such as a semiconductor wafer. A polishing liquid supply nozzle 102 is provided above the polishing table 100 to supply a polishing liquid Q onto the polishing pad 101 on the polishing table 100.

The top ring 1 is connected to a top ring shaft 111, and the top ring shaft 111 is vertically movable with respect to a top ring head 110 by a vertically movable mechanism 124. When the top ring shaft 111 moves vertically, the top ring 1 is lifted and lowered as a whole for positioning with respect to the top ring head 110. A rotary joint 125 is mounted on the upper end of the top ring shaft 111.

Various kinds of polishing pads are sold on the market. For example, some of these are SUBA800, IC-1000, and IC-1000/SUBA400 (two-layer cloth) manufactured by Dow Chemical Company, and Surfin xxx-5 and Surfin 000 manufactured by Fujimi Inc. SUBA800, Surfin xxx-5, and Surfin 000 are non-woven fabrics bonded by urethane resin, and IC-1000 is rigid foam polyurethane (single-layer). Foam polyurethane is porous and has a large number of fine recesses or holes formed in its surface.

The vertical movement mechanism 124, which vertically moves the top ring shaft 111 and the top ring 1, has a bridge 128 supporting the top ring shaft 111 in a manner such that the top ring shaft 111 is rotatable via a bearing 126, a ball screw 132 mounted on the bridge 128, a support stage 129 which is supported by poles 130, and an AC servomotor 138 provided on the support stage 129. The support stage 129, which supports the servomotor 138, is fixed to the top ring head 110 via the poles 130.

The ball screw 132 has a screw shaft 132*a* which is coupled to the servomotor 138, and a nut 132*b* into which the screw shaft 132*a* is threaded. The top ring shaft 111 is configured to be vertically movable together with the bridge 128. Accordingly, when the servomotor 138 is driven, the bridge 128 is vertically moved through the ball screw 132. As a result, the top ring shaft 111 and the top ring 1 are vertically moved.

Further, the top ring shift 111 is connected to a rotary sleeve 112 by a key (not shown). The rotary sleeve 112 has a timing pulley 113 fixedly disposed therearound. A top ring motor 114 is fixed to the top ring head 110. The timing pulley 113 is operatively coupled to a timing pulley 116 provided on the top ring motor 114 by a timing belt 115. Therefore, when the top ring motor 114 is driven, the timing pulley 116, the timing belt 115 and the timing pulley 113 are rotated to rotate the rotary sleeve 112 and the top ring shaft 111 in unison with each other, thus rotating the top ring 1. The top ring head 110 is supported on a top ring head shaft 117 which is rotatably supported by a frame (not shown).

In the polishing apparatus constructed as shown in FIG. 1, the top ring 1 is configured to hold a substrate W such as a semiconductor wafer on its lower surface. The top ring head 110 is pivotable about the top ring shaft 117. Thus, the top ring 1, which holds the substrate W on its lower surface, is moved from a position at which the top ring 1 receives the substrate W to a position above the polishing table 100 by pivotable movement of the top ring head 110. Then, the top ring 1 is lowered to press the substrate W against a surface (polishing surface) 101*a* of the polishing pad 101. At this time, while the top ring 1 and the polishing table 100 are respectively rotated, a polishing liquid is supplied onto the polishing pad 101 from the polishing liquid supply nozzle 102 provided above the polishing table 100. In this manner, the substrate W is brought into sliding contact with the polishing surface 101*a* of the polishing pad 101. Thus, a surface of the substrate W is polished.

Figure 2:
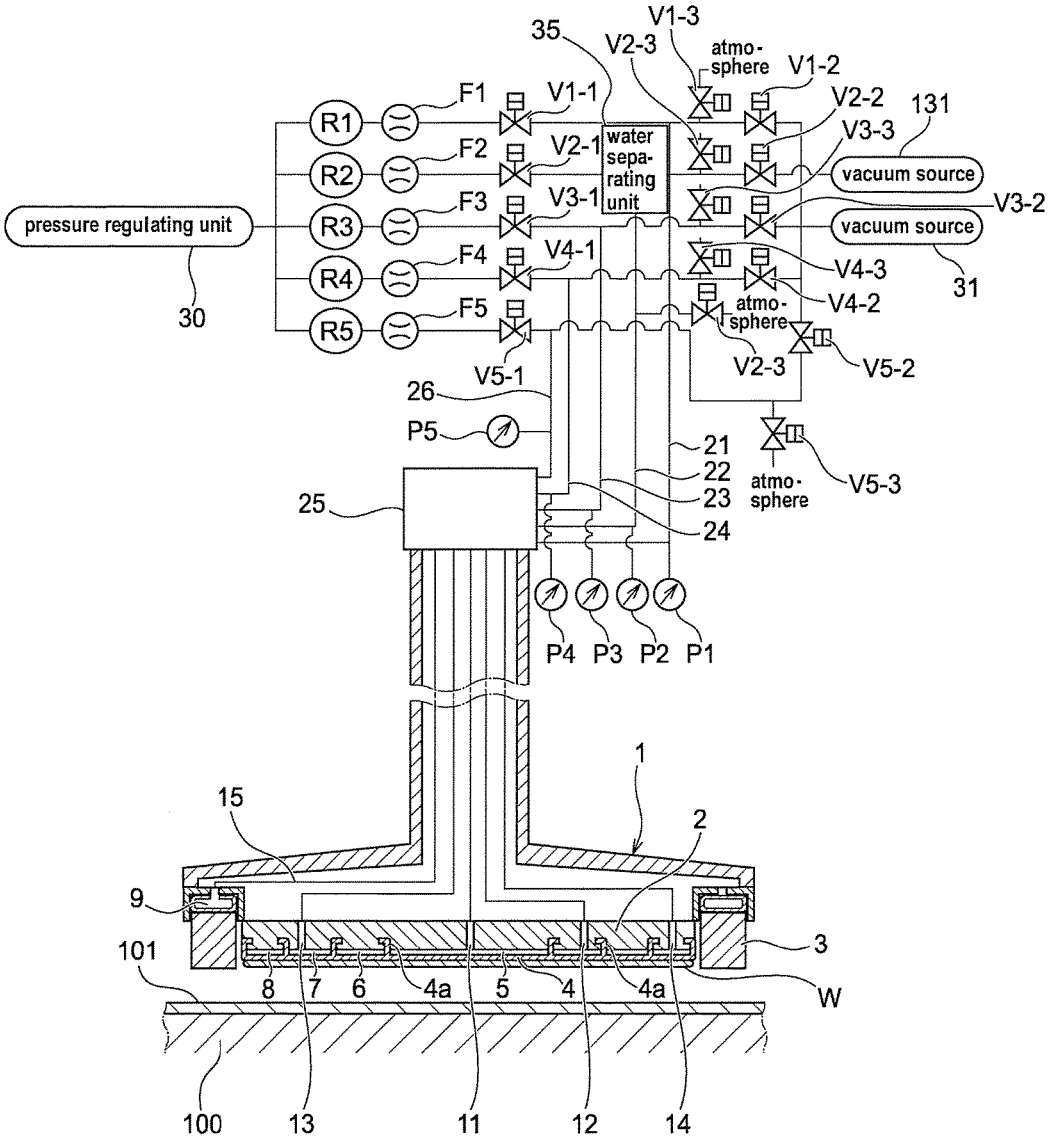
FIG. 2 is a schematic cross-sectional view showing a top ring constituting a polishing head (substrate holding apparatus) for holding a substrate such as a semiconductor wafer to be polished and pressing the substrate against a polishing surface on a polishing table.

Next, the top ring of the polishing apparatus according to the present invention will be described. FIG. 2 is a schematic cross-sectional view showing the top ring 1 constituting a substrate holding apparatus for holding a substrate as an object to be polished and pressing the substrate against the polishing surface on the polishing table. FIG. 2 shows only main structural elements constituting the top ring 1. As shown in FIG. 2, the top ring 1 basically comprises a top ring body 2, also referred to as carrier, for pressing a substrate W against the polishing surface 101*a*, and a retainer ring 3 for directly pressing the polishing surface 101*a*. The top ring body (carrier) 2 is in the form of a circular plate, and the retainer ring 3 is attached to a peripheral portion of the top ring body 2. The top ring body 2 is made of resin such as engineering plastics (e.g. PEEK). As shown in FIG. 2, the top ring 1 has an elastic membrane (membrane) 4 attached to a lower surface of the top ring body 2. The elastic membrane 4 is brought into contact with a rear face of the substrate held by the top ring 1. The elastic membrane (membrane) 4 is made of a highly strong and durable rubber material such as ethylene propylene rubber (EPDM), polyurethane rubber, silicone rubber, or the like.

The elastic membrane (membrane) 4 has a plurality of concentric partition walls 4*a*, and a circular central chamber 5, an annular ripple chamber 6, an annular outer chamber 7 and an annular edge chamber 8 are defined by the partition walls 4*a* between the upper surface of the elastic membrane 4 and the lower surface of the top ring body 2. Specifically, the central chamber 5 is defined at the central portion of the top ring body 2, and the ripple chamber 6, the outer chamber 7 and the edge chamber 8 are concentrically defined in the order from the central portion to the peripheral portion of the top ring body 2. A passage 11 communicating with the central chamber 5, a passage 12 communicating with the ripple chamber 6, a passage 13 communicating with the outer chamber 7 and a passage 14 communicating with the edge chamber 8 are formed in the top ring body 2. The passage 11 communicating with the center chamber 5, the passage 13 communicating with the outer chamber 7 and the passage 14 communicating with the edge chamber 8 are connected via a rotary joint 25 to passages 21, 23 and 24, respectively. The respective passages 21, 23 and 24 are connected via respective valves V1-1, V3-1, V4-1 and respective pressure regulators R1, R3, R4 to a pressure regulating unit 30. Further, the respective passages 21, 23 and 24 are connected via respective valves V1-2, V3-2, V4-2 to a vacuum source 31, and are also connected via respective valves V1-3, V3-3, V4-3 to the atmosphere.

On the other hand, the passage 12 communicating with the ripple chamber 6 is connected via the rotary joint 25 to the passage 22. The passage 22 is connected via a water separating tank 35, a valve V2-1 and the pressure regulator R2 to the pressure regulating unit 30. Further, the passage 22 is connected via the water separating tank 35 and the valve V2-2 to a vacuum source 131, and is also connected via a valve V2-3 to the atmosphere.

Further, a retainer ring chamber 9 made of an elastic membrane is formed immediately above the retainer ring 3, and the retainer ring chamber 9 is connected via a passage 15 formed in the top ring body (carrier) 2 and the rotary joint 25 to a passage 26. The passage 26 is connected via a valve V5-1 and a pressure regulator R5 to the pressure regulating unit 30. Further, the passage 26 is connected via a valve V5-2 to the vacuum source 31, and is also connected via a valve V5-3 to the atmosphere. The pressure regulators R1, R2, R3, R4 and R5 have a pressure adjusting function for adjusting pressures of the pressurized fluid supplied from the pressure regulating unit 30 to the central chamber 5, the ripple chamber 6, the outer chamber 7, the edge chamber 8 and the retainer ring chamber 9, respectively. The pressure regulators R1, R2, R3, R4 and R5 and the respective valves V1-1-V1-3, V2-1-V2-3, V3-1-V3-3, V4-1-V4-3 and V5-1-V5-3 are connected to a controller (not shown), and operations of these pressure regulators and these valves are controlled by the controller. Further, pressure sensors P1, P2, P3, P4 and P5 and flow rate sensors F1, F2, F3, F4 and F5 are provided in the passages 21, 22, 23, 24 and 26, respectively.

In the top ring 1 constructed as shown in FIG. 2, as described above, the central chamber 5 is defined at the central portion of the top ring body 2, and the ripple chamber 6, the outer chamber 7 and the edge chamber 8 are concentrically defined in the order from the central portion to the peripheral portion of the top ring body 2. The pressures of the fluid supplied to the central chamber 5, the ripple chamber 6, the outer chamber 7, the edge chamber 8 and the retainer ring chamber 9 can be independently controlled by the pressure regulating unit 30 and the pressure regulators R1, R2, R3, R4 and R5. The area of the membrane 4 corresponding to the central chamber 5 presses the central portion of the substrate W against the polishing pad 101, the area of the membrane 4 corresponding to the ripple chamber 6 presses the intermediate portion of the substrate W against the polishing pad 101, and the area of the membrane 4 corresponding to the outer chamber 7 presses the peripheral portion of the substrate W against the polishing pad 101. With this arrangement, pressing forces for pressing the substrate W against the polishing pad 101 can be adjusted at respective local areas of the substrate, and a pressing force for pressing the polishing pad 101 by the retainer ring 3 can be adjusted.

Next, a series of polishing processes of the polishing apparatus shown in FIGS. 1 and 2 will be described.

The top ring 1 receives the substrate W from a substrate transfer unit and holds the substrate W under vacuum. The elastic membrane 4 has a plurality of holes (not shown) for holding the substrate W under vacuum, and these holes are connected to a vacuum source. The top ring 1 which holds the substrate W under vacuum is lowered to a preset polishing position of the top ring which has been preset. At the preset polishing position, the retainer ring 3 is brought into contact with the surface (polishing surface) 101*a* of the polishing pad 101. However, before the substrate W is polished, since the substrate W is attracted to and held by the top ring 1, there is a small gap of about 1 mm, for example, between the lower surface (surface to be polished) of the substrate W and the polishing surface 101*a* of the polishing pad 101. At this time, the polishing table 100 and the top ring 1 are being rotated about their own axes. In this state, a pressurized fluid is supplied to the respective pressure chambers, and the elastic membrane (membrane) 4 located at the upper surface (rear surface) of the substrate W is inflated to bring the lower surface of the substrate W into contact with the polishing surface 101*a* of the polishing pad 101. As the polishing table 100 and the top ring 1 are being moved relative to each other, polishing of the substrate W is started. By adjusting pressures of the fluid to be supplied to the respective pressure chambers 5, 6, 7, 8, 9, pressing forces for pressing the substrate W against the polishing pad 101 are adjusted at respective local areas of the substrate W, and a pressing force for pressing the polishing pad 101 by the retainer ring 3 is adjusted. In this manner, the substrate is polished until the surface of the substrate becomes a predetermined state, e.g. a predetermined thickness.

After completing substrate processing on the polishing pad 101, the substrate W is vacuum-chucked to the top ring 1, and the top ring 1 is lifted and is then moved to the substrate transfer unit (pusher) where the substrate W is removed from the top ring 1.

Figure 3:
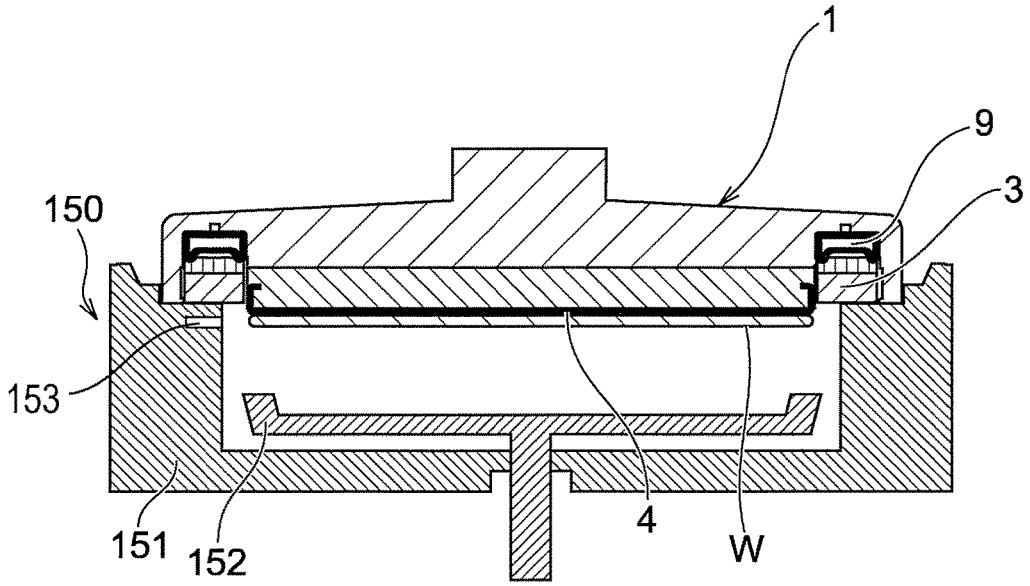
FIG. 3 is a schematic view showing the top ring and a pusher, and is the view showing the state in which the pusher is elevated in order to transfer the substrate from the top ring to the pusher.

FIG. 3 is a schematic view showing the top ring 1 and a pusher 150, and is the view showing the state in which the pusher is elevated in order to transfer the substrate from the top ring 1 to the pusher 150. As shown in FIG. 3, the pusher 150 comprises a top ring guide 151 capable of being fitted with the outer peripheral surface of the retainer ring 3 for centering the top ring 1, a pusher stage 152 for supporting the substrate when the substrate is transferred between the top ring 1 and the pusher 150, an air cylinder (not shown) for vertically moving the pusher stage 152, and an air cylinder (not shown) for vertically moving the pusher stage 152 and the top ring guide 151.

In a process of transferring the substrate W from the top ring 1 to the pusher 150, after the top ring 1 is moved above the pusher 150, the pusher stage 152 and the top ring guide 151 of the pusher 150 are lifted, and the top ring guide 151 is fitted with the outer peripheral surface of the retainer ring 3 to perform centering of the top ring 1 and the pusher 150. At this time, the top ring guide 151 pushes the retainer ring 3 up, and at the same time, vacuum is created in the retainer ring chamber 9, thereby lifting the retainer ring 3 quickly. Then, when lifting of the pusher is completed, the bottom surface of the retainer ring 3 is pushed by the upper surface of the top ring guide 151 and is thus located at a vertical position higher than the lower surface of the membrane 4. Therefore, a boundary between the substrate and the membrane is exposed. In the example shown in FIG. 3, the bottom surface of the retainer ring 3 is located at a position higher than the lower surface of the membrane by 1 mm. Thereafter, vacuum-chucking of the substrate W to the top ring 1 is stopped, and substrate release operation is carried out. Instead of lifting of the pusher, the top ring may be lowered to arrange a desired positional relationship between the pusher and the top ring.

The pusher 150 has release nozzles 153 formed in the top ring guide 151 for ejecting a fluid. A plurality of release nozzles 153 are provided at certain intervals in a circumferential direction of the top ring guide 151 to eject a mixed fluid of pressurized nitrogen and pure water in a radially inward direction of the top ring guide 151. Thus, a release shower comprising the mixed fluid of pressurized nitrogen and pure water is ejected between the substrate W and the membrane 4, thereby performing substrate release for removing the substrate from the membrane. Although the mixed fluid of pressurized nitrogen and pure water is ejected from the release nozzles 153, only a pressurized gas or a pressurized liquid may be ejected from the release nozzles 153. Further, a pressurized fluid of other combination may be ejected from the release nozzles 153. In some cases, adhesive force between the membrane and the rear surface of the substrate is strong and the substrate is difficult to be removed from the membrane only by ejecting the release shower. In such cases, one pressure chamber, e.g., the ripple chamber 6 should be pressurized at a low pressure of not more than 0.1 MPa to assist removal of the substrate.

Figure 4B:
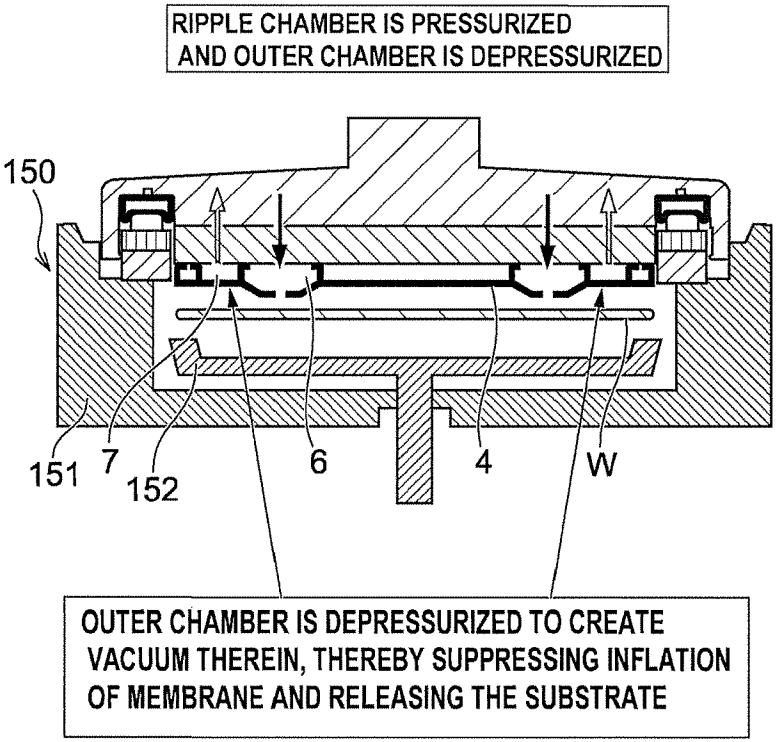
FIG. 4A and FIG. 4B are schematic views showing the case in which a ripple area is pressurized when the substrate is removed from a membrane, FIG. 4A being a schematic view showing the case where the ripple area is pressurized, and FIG. 4B being a schematic view showing the case where the ripple area is pressurized and an outer area is depressurized to create a vacuum therein.
Figure 4A:
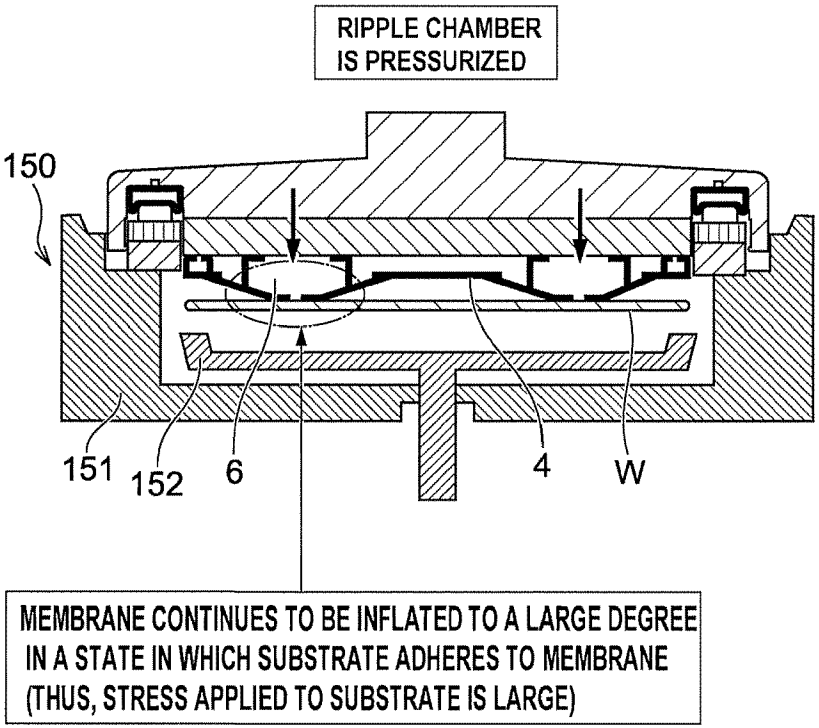

FIG. 4A is a schematic view showing the case in which the pressure chamber is pressurized when the substrate is removed from the membrane. As shown in FIG. 4A, when the pressure chamber, e.g., the ripple chamber 6 is pressurized, the membrane 4 continues to be inflated to a large degree in a state in which the substrate W adheres to the membrane 4. Thus, stress applied to the substrate is large, and fine interconnections formed on the substrate are broken or the substrate itself is damaged at the worst.

Then, in Japanese laid-open patent publication No. 2010-46756, as shown in FIG. 4B, in the case where the pressure chamber (ripple chamber 6) is pressurized, in order to prevent the membrane from continuing to be inflated in a state in which the substrate W adheres to the membrane 4, the area other than the ripple area is depressurized to create a vacuum therein, thereby suppressing inflation of the membrane 4. In the example shown in FIG. 4B, the outer chamber 7 is depressurized to create a vacuum therein, thereby suppressing inflation of the membrane 4. However, in the method shown in FIG. 4B, it takes time to create a vacuum in the pressure chamber, resulting in poor responsiveness. Accordingly, it takes time to release (remove) the substrate. Further, when the pressure chamber is depressurized to create a vacuum therein, a part of the substrate is pulled to increase the amount of deformation of the substrate.

In order to solve such problems which occur during substrate release as shown in FIG. 4A and FIG. 4B, the present invention has the following elements:

1) At least one of plural pressure chambers is pressurized when the substrate W is removed (released) from the top ring 1;

2) A stopper for limiting the range of movement of the partition wall 4*a* is provided at a position below a horizontal portion or an inclined portion of the partition wall 4*a* of the membrane 4, which defines the pressure chamber to be pressurized, to prevent the membrane from being inflated in excess of a certain amount when the pressure chamber is pressurized.

Next, a specific configuration of a stopper provided as a part of the top ring body (carrier) 2 in order to limit the range of movement of the partition wall 4*a* of the membrane 4 will be described with reference to FIGS. 5 through 14.

Figure 5:
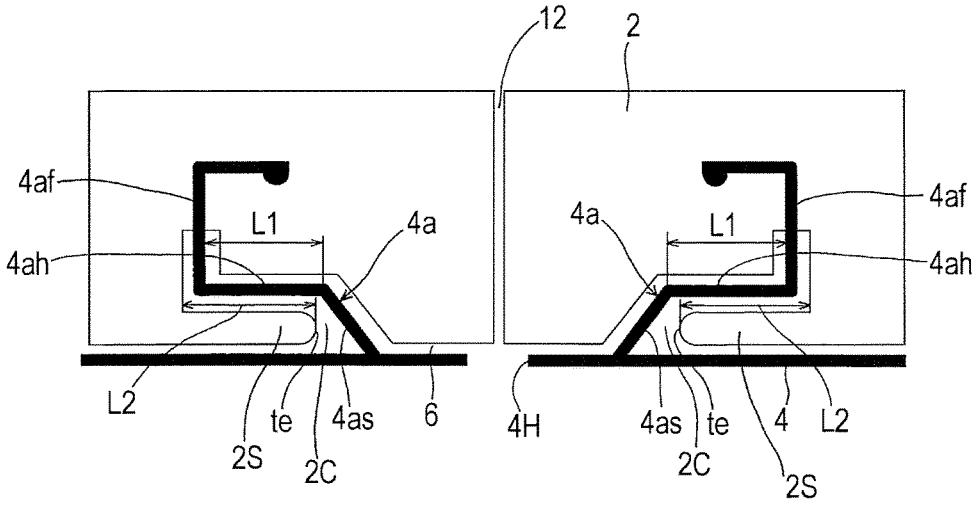
FIG. 5 is a view showing a first embodiment of the present invention, and is a schematic cross-sectional view showing the relationship between partition walls of the membrane and stoppers formed on a part of a top ring body (carrier)

FIG. 5 is a view showing a first embodiment of the present invention, and is a schematic cross-sectional view showing the relationship between the partition walls 4*a* of the membrane 4 and stoppers formed on a part of the top ring body (carrier) 2. As shown in FIG. 5, the membrane 4 has the partition walls 4*a* for partitioning two adjacent pressure chambers. In the example shown in FIG. 5, the right and left partition walls 4*a*, 4*a* for defining one pressure chamber, for example, the ripple chamber 6 are shown, and the partition walls 4*a*, 4*a* are configured symmetrically. Specifically, the partition walls 4*a*, 4*a* are symmetric with respect to the passage 12 for the pressurized fluid. An opening 4H facing the passage 12 is formed in the membrane 4. Each of the partition walls 4*a* has a bent portion in consideration of its stretchability in a vertical direction (perpendicular direction). Specifically, each of the partition walls 4*a* of the membrane 4 comprises an inclined portion 4*as* extending obliquely upward from the rear surface of the membrane whose surface serves as a substrate holding surface, a horizontal portion 4*ah* extending horizontally from the inclined portion 4*as*, and a fixing portion 4*af* extending vertically from the horizontal portion 4*ah* to fix the partition wall 4*a* to the top ring body (carrier) 2.

On the other hand, the top ring body (carrier) 2 has, on its lower end, two cavities 2C, 2C for housing the partition walls 4*a*, 4*a* of the membrane 4. The top ring body (carrier) 2 also has two stoppers 2S, 2S extending horizontally from side walls of the cavities 2C, 2C and having a length L2, which is substantially the same as the whole length L1 of the horizontal portion 4*ah* of the partition wall 4*a*. The stoppers 2S, 2S are symmetric with respect to the passage 12 for the pressurized fluid. Each of the stoppers 2S is located below the horizontal portion 4*ah* of the partition wall 4*a*.

According to the present invention, the partition wall 4*a* of the membrane 4 and the stopper 2S are configured as follows:

1) The stopper 2S having a length L2 which is substantially the same as the whole length L1 of the horizontal portion 4*ah* of the partition wall 4*a*, is disposed below the horizontal portion 4*ah* of the partition wall 4*a*. With this arrangement, the range of vertical movement of the partition wall 4*a* is limited effectively, and the amount of inflation of the membrane 4 is limited when the membrane 4 is pressurized, in such a state that the substrate held by the membrane 4 is not brought into contact with the polishing surface as in the case of removal of the substrate, and the substrate-pressing-surface of the membrane 4 for pressing the substrate is freely expandable;

2) A clearance of 0.5 to 3.0 mm is provided between the horizontal portion 4*ah* of the partition wall 4*a* and the stopper 2S. By this clearance, the partition wall 4*a* can follow the substrate W during polishing, even if the distance from the mounting position of the partition wall of the membrane to the polishing pad varies in the case where the thickness of consumable parts such as a polishing pad or a retainer ring varies, or the polishing parameters are changed;

3) A tip corner te of the stopper 2S is rounded (chamfered) to a radius of not less than 1.0 mm (R1.0). By this configuration, the membrane 4 is prevented from being damaged by the tip corner te of the stopper 2S; and 4) A surface treatment such as fluorine coating is applied to at least one of the surfaces of the stopper 2S and the partition wall 4*a*. In the case where the stopper 2S and the membrane partition wall 4*a* stick together, tension is applied to the partition wall 4*a*, i.e. the vertical movement of the partition wall 4*a* is hindered during polishing of the substrate. Thus, the pressing force for pressing the substrate against the polishing pad becomes non-uniform at the area where the vertical movement of the partition wall 4*a* is hindered. By application of the surface treatment to at least one of the surfaces of the stopper 2S and the partition wall 4*a*, the stopper 2S and the partition wall 4*a* are prevented from sticking together.

Figure 6:
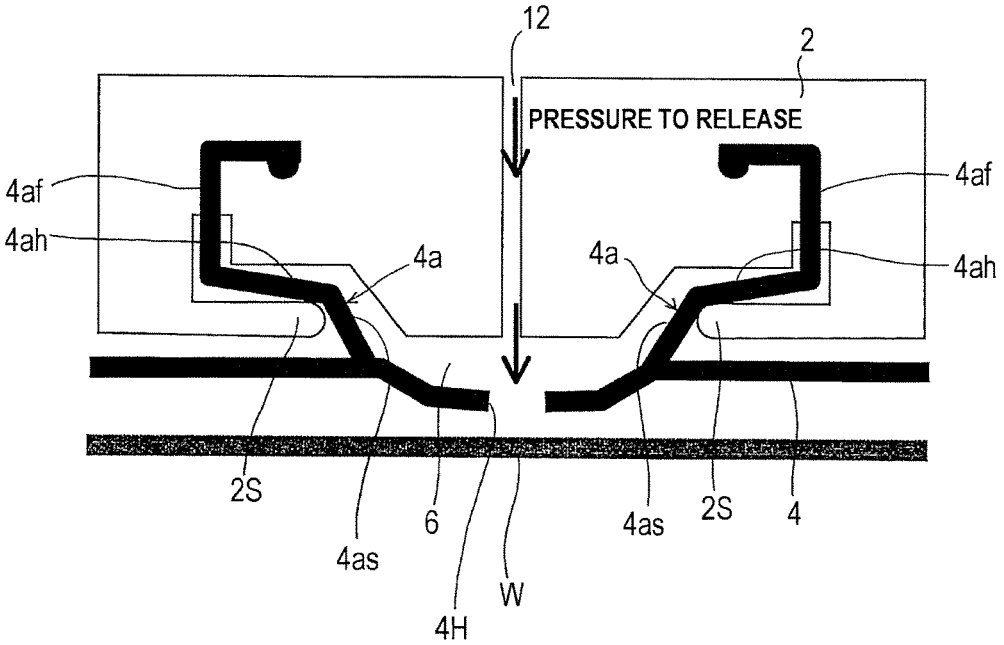
FIG. 6 is a schematic cross-sectional view showing a state in which the substrate is released by supplying a pressurized fluid to a pressure chamber of the top ring having the stoppers shown in FIG. 5.

FIG. 6 is a schematic cross-sectional view showing a state in which the substrate W is released by supplying a pressurized fluid to the pressure chamber of the top ring 1 having the stoppers 2S shown in FIG. 5. As shown in FIG. 6, when one pressure chamber, e.g., the ripple chamber 6 is pressurized, a downward pressure is applied to the membrane 4. The angle between the horizontal portion 4*ah* and the vertical fixing portion 4*af* of the partition wall 4*a* is widened, and the horizontal portion 4*ah* is inclined downwardly. Accordingly, the partition wall 4*a* is moved in a vertical direction. At this time, the inclination of the horizontal portion 4*ah* is limited by the stopper 2S so that the range of vertical movement of the partition wall 4*a* is limited and the amount of inflation of the membrane 4 is limited. Therefore, the stress applied to the substrate during substrate release can be dramatically reduced. Further, since it is not necessary to depressurize other pressure chambers to create a vacuum therein during substrate release, the substrate can be released in a short time. The pressurized fluid supplied to the pressure chamber (ripple chamber 6) is ejected through the opening 4H of the membrane 4 and presses the substrate W downward, thereby removing the substrate W from the membrane 4.

Figure 7:
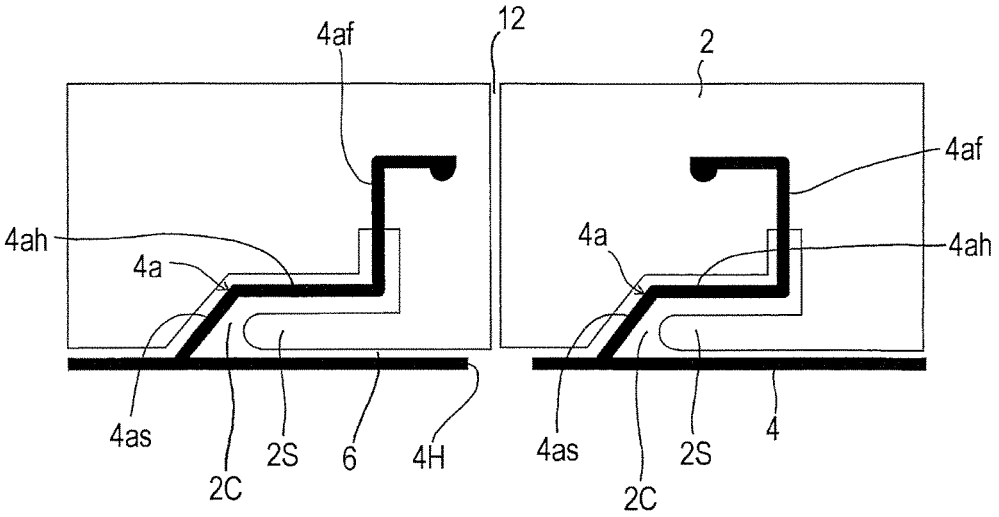
FIG. 7 is a view showing a second embodiment of the present invention, and is a schematic cross-sectional view showing the relationship between partition walls of the membrane and stoppers formed on a part of the top ring body (carrier)

FIG. 7 is a view showing a second embodiment of the present invention, and is a schematic cross-sectional view showing the relationship between the partition walls 4*a* of the membrane 4 and stoppers formed on a part of the top ring body (carrier) 2. In the example shown in FIG. 7, the right and left partition walls 4*a*, 4*a* of the membrane 4 have inclined portions 4*as*, 4*as* inclined in the same direction, and horizontal portions 4*ah*, 4*ah* extending in the same direction. Specifically, in the top ring body (carrier) 2, two cavities 2C, 2C and two stoppers 2S, 2S extend in the same direction. The partition walls 4*a* and the stoppers 2S in the present embodiment have configurations described in the above 1) through 4) as with the embodiment shown in FIG. 5.

Figure 8:
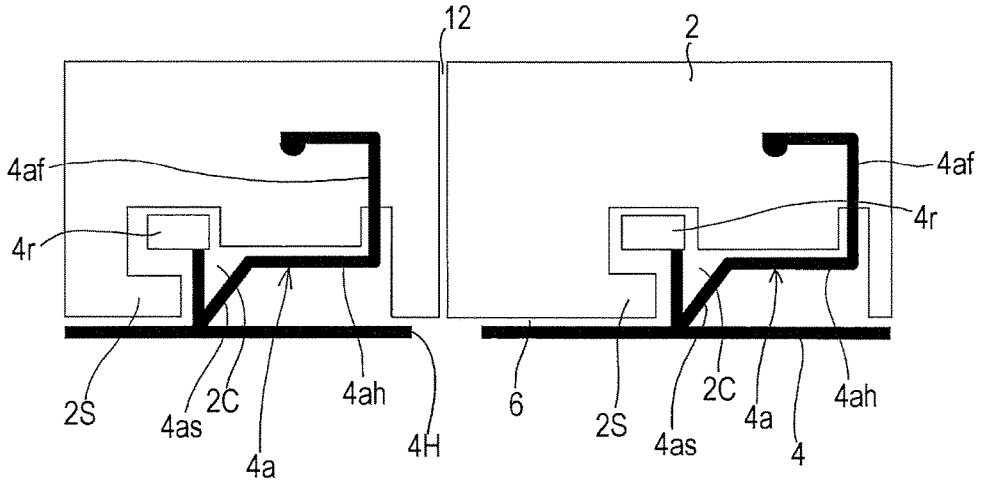
FIG. 8 is a view showing a third embodiment of the present invention, and is a schematic cross-sectional view showing the relationship between partition walls of the membrane and stoppers formed on a part of the top ring body (carrier)

FIG. 8 is a view showing a third embodiment of the present invention, and is a schematic cross-sectional view showing the relationship between annular ribs formed on the membrane 4 and stoppers formed on a part of the top ring body (carrier) 2. In the example shown in FIG. 8, the annular ribs 4*r* are provided so as to extend upward from the rear surface of the membrane 4 whose surface serves as a substrate holding surface. Each of the partition walls 4*a* of the membrane 4 comprises an inclined portion 4*as*, a horizontal portion 4*ah*, and a fixing portion 4*af* as with the embodiment shown in FIG. 5.

On the other hand, the top ring body 2 has, on its lower end, two cavities 2C, 2C for housing the partition walls 4*a*, 4*a* and the annular ribs 4*r*, 4*r* of the membrane 4. The top ring body 2 also has two stoppers 2S, 2S extending from side walls of the cavities 2C, 2C. In the embodiment shown in FIG. 8, when one pressure chamber, e.g. the ripple chamber 6 is pressurized during substrate release operation, a downward pressure is applied to the membrane 4. Accordingly, the horizontal portion 4*ah* is inclined downwardly, and the partition wall 4*a* is moved in a vertical direction. At this time, although the annular rib 4*r* is moved downwardly, when the annular rib 4*r* moves by a predetermined distance, the annular rib 4*r* is brought into contact with the stopper 2S. Thus, the range of vertical movement of the partition wall 4*a* is limited, and the amount of inflation of the membrane 4 is limited. The annular rib 4*r* constitutes an extending member extending from the rear surface of the membrane 4 whose surface serves as a substrate holding surface. A clearance between the annular rib 4*r* and the stopper 2S is set to be 0.5 to 3.0 mm so that the vertical movement of the partition wall of the membrane is not hindered during substrate polishing. By application of surface treatment such as fluorine coating to at least one of the surfaces of the stopper 2S and the annular rib 4*r*, the stopper 2S and the annular rib 4*r* are prevented from sticking together.

Figure 9:
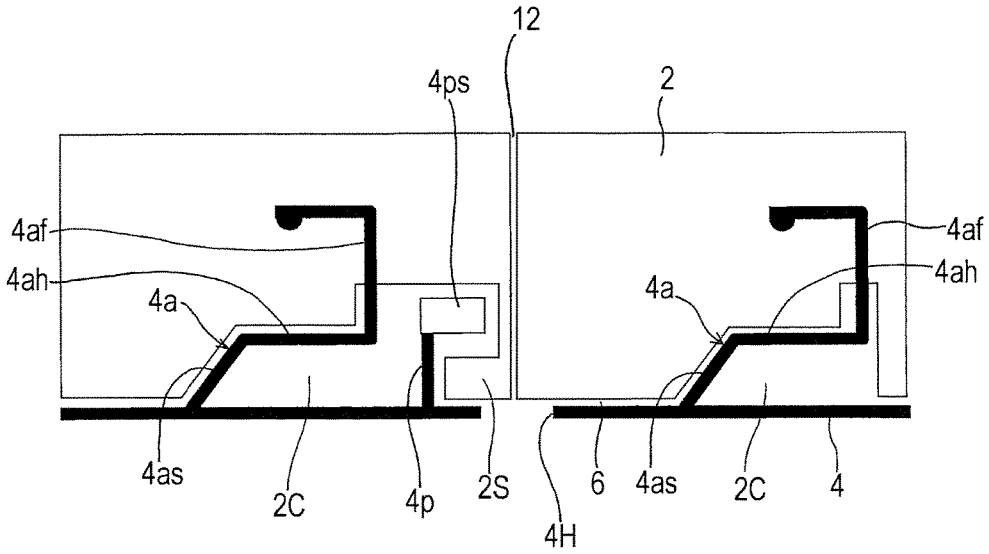
FIG. 9 is a view showing a fourth embodiment of the present invention, and is a schematic cross-sectional view showing the relationship between partition walls of the membrane and stoppers formed on a part of the top ring body (carrier)

FIG. 9 is a view showing a fourth embodiment of the present invention, and is a schematic cross-sectional view showing the relationship between support rods (support members) formed on the membrane 4 and stoppers formed on a part of the top ring body (carrier) 2. In the example shown in FIG. 9, three or more support rods (support members) 4*p* are provided so as to extend upward from the rear surface of the membrane 4 whose surface serves as a substrate holding surface. These three or more support rods 4*p* are provided at intervals in a circumferential direction. The support rods 4*p* extend upward at a substantially central area of the pressure chamber, i.e. a substantially intermediate position of two partition walls 4*a*, 4*a*. The upper end of the support rod 4*p* is bent to a horizontal direction and a bent portion 4*ps* is configured to be capable of being brought into contact with the stopper 2S formed on the lower end of the top ring body (carrier) 2. The support rod 4*p* constitutes an extending member extending from the rear surface of the membrane 4 whose surface serves as a substrate holding surface. A clearance between the bent portion 4*ps* and the stopper 2S is set to be 0.5 to 3.0 mm as with the embodiment shown in FIG. 8. The surface treatment and other configurations are the same as the embodiment shown in FIG. 8. According to the embodiment shown in FIG. 9, the downward inflation of the membrane 4 at a substantially central area of the pressure chamber is limited.

Figure 10:
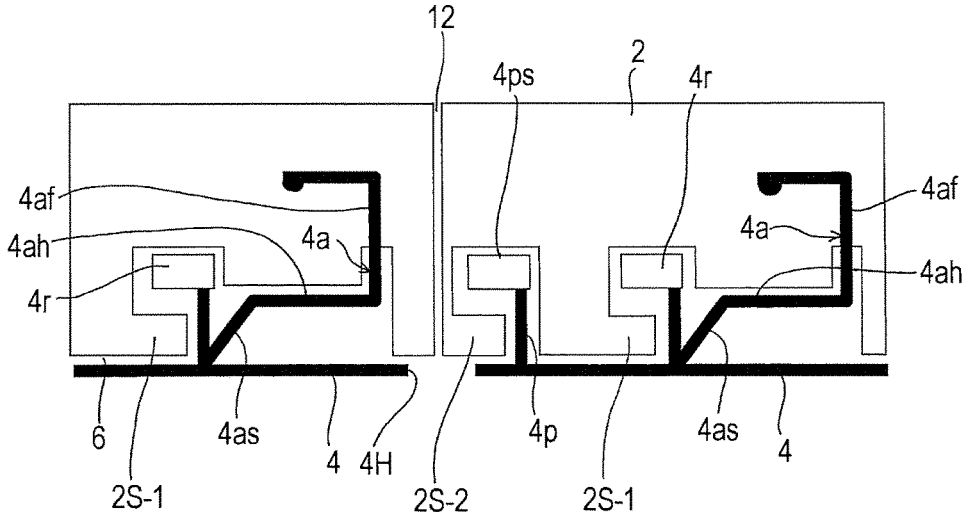
FIG. 10 is a view showing a fifth embodiment of the present invention, and is a schematic cross-sectional view showing the relationship between partition walls of the membrane and stoppers formed on a part of the top ring body (carrier)

FIG. 10 is a view showing a fifth embodiment of the present invention, and is a schematic cross-sectional view showing the relationship between annular ribs and support rods formed on the membrane 4, and stoppers formed on a part of the top ring body (carrier) 2. In the example shown in FIG. 10, both of annular ribs 4*r* shown in FIG. 8 and support rods 4*p* shown in FIG. 9 are provided. Specifically, the membrane 4 has annular ribs 4*r* extending upward from the rear surface of the membrane 4 whose surface serves as a substrate holding surface, and three or more support rods 4*p* extending upward from the rear surface of the membrane 4 whose surface serves as a substrate holding surface. The top ring body (carrier) 2 has stoppers 2S-1 capable of being brought into contact with the annular ribs 4*r*, and stoppers 2S-2 capable of being brought into contact with bent portions 4*ps* of the support rods 4*p*. In FIG. 10, the stopper capable of being brought into contact with the annular rib 4*r* and the stopper capable of being brought into contact with the bent portion 4*ps* of the support rod 4*p* are distinguished by using suffixes 1, 2 after 2S. A clearance between the annular rib 4*r* and the stopper 2S-1 and a clearance between the bent portion 4*ps* of the support rod 4*p* and the stopper 2S-2 are set to be 0.5 to 3.0 mm. According to the embodiment shown in FIG. 10, the range of vertical movement of the partition wall 4*a* is limited at the position near the partition wall 4*a* of the pressure chamber by the annular rib 4*r* and the stopper 2S-1, and the downward inflation of the membrane 4 is limited at a substantially central area of the pressure chamber by the support rod 4*p* and the stopper 2S-2. Therefore, the inflation of the membrane 4 can be limited at various positions during substrate release.

Figure 11:
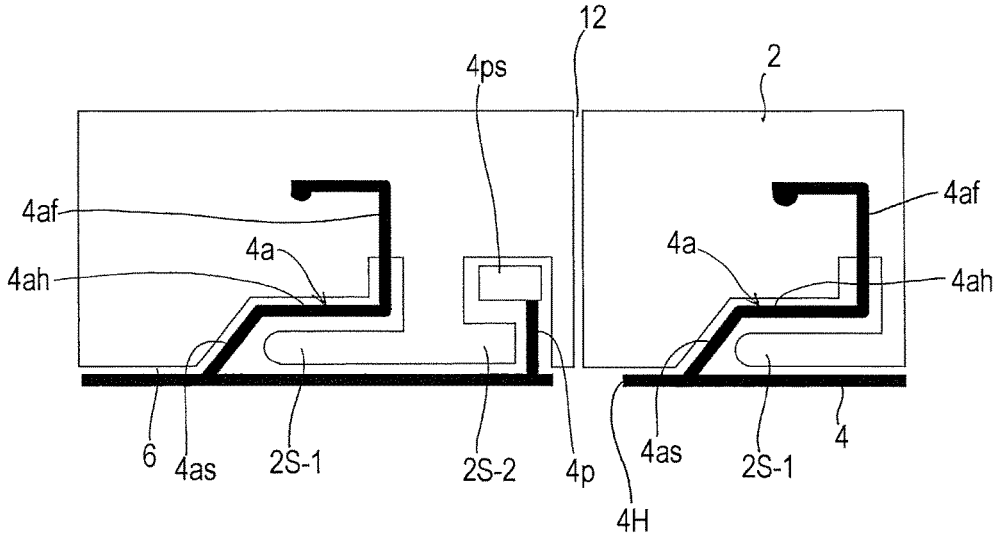
FIG. 11 is a view showing a sixth embodiment of the present invention, and is a schematic cross-sectional view showing the relationship between partition walls of the membrane and stoppers formed on a part of the top ring body (carrier)

FIG. 11 is a view showing a sixth embodiment of the present invention, and is a schematic cross-sectional view showing the relationship between the partition wall 4*a* of the membrane 4 and support rods formed on the membrane 4, and stoppers formed on a part of the top ring body (carrier) 2. In the example shown in FIG. 11, both of stopper 2S-1 capable of being brought into contact with a horizontal portion 4*ah* of the partition wall 4*a* shown in FIG. 5 and stopper 2S-2 capable of being brought into contact with a bent portion 4*ps* of the support rod 4*p* shown in FIG. 9 are provided. In FIG. 11, the stopper capable of being brought into contact with the horizontal portion 4*ah* of the partition wall 4*a* and the stopper capable of being brought into contact with the bent portion 4*ps* of the support rod 4*p* are distinguished by using suffixes 1, 2 after 2S. According to this embodiment, the inclination of the horizontal portion 4*ah* of the partition wall 4*a* is limited by the stopper 2S-1 so that the range of vertical movement of the partition wall 4*a* is limited, and the amount of inflation of the membrane 4 is limited. Further, the downward inflation of the membrane 4 is limited at a substantially central area of the pressure chamber by the support rod 4*p* and the stopper 2S-2.

Figure 12:
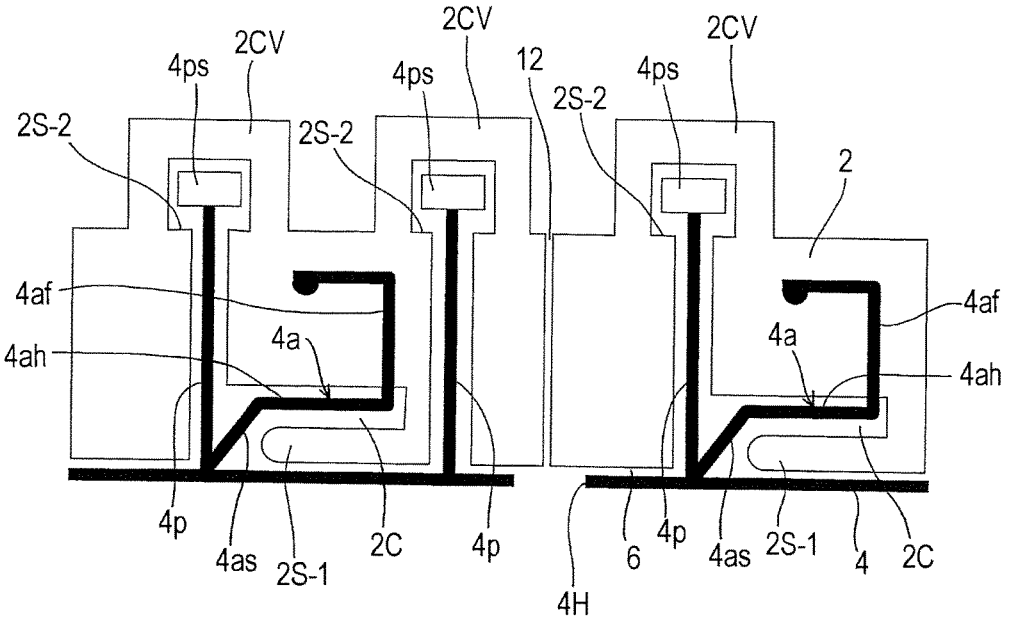
FIG. 12 is a view showing a seventh embodiment of the present invention, and is a schematic cross-sectional view showing the relationship between partition walls of the membrane and stoppers formed on a part of the top ring body (carrier)

FIG. 12 is a view showing a seventh embodiment of the present invention, and is a schematic cross-sectional view showing the relationship between the partition wall 4*a* of the membrane 4 and support rods formed on the membrane 4, and stoppers formed on a part of the top ring body (carrier) 2. In the example shown in FIG. 12, in addition to the stoppers 2S-1 capable of being brought into contact with the horizontal portions 4*ah* of the partition walls 4*a* shown in FIG. 7, a plurality of support rods 4*p* passing through the carrier and extending upward from the rear surface of the membrane 4 whose surface serves as a substrate holding surface, and stoppers 2S-2 capable of being brought into contact with bent portions 4*ps* formed at the upper ends of the support rods 4*p* are provided. In FIG. 12, the stoppers capable of being brought into contact with the horizontal portions 4*ah* of the partition walls 4*a* and the stoppers capable of being brought into contact with the bent portions 4*ps* of the support rods 4*p* are distinguished by using suffixes 1, 2 after 2S. In the present embodiment, the stopper 2S-2 comprises the upper end portion of the top ring body (carrier) 2. The plural support rods 4*p* extend from a base portion of the partition wall 4*a* (joint portion of the partition wall 4*a* and the membrane 4) and from a substantially central area of the pressure chamber (a substantially intermediate position between two partition walls 4*a*, 4*a*), respectively. In the top ring body 2, container-like covers 2CV are provided so as to enclose the upper portions of the support rods 4*p* and the bent portions 4*ps*, thereby keeping the pressure chambers airtight. According to this embodiment, the inclination of the horizontal portion 4*ah* of the partition wall 4*a* is limited by the stopper 2S-1 so that the range of vertical movement of the partition wall 4*a* is limited and the amount of inflation of the membrane 4 is limited. Further, the downward inflation of the membrane 4 is limited at the base portion of the partition wall 4*a* and the substantially central area of the pressure chamber by the support rod 4*p* and the stopper 2S-2. Therefore, the inflation of the membrane 4 can be limited at various positions during substrate release.

Figure 13A:
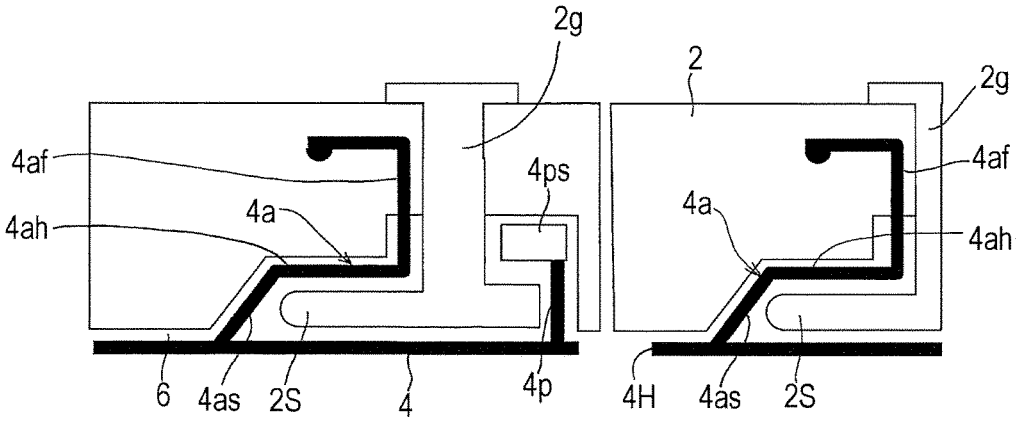
FIG. 13A and FIG. 13B are views showing an eighth embodiment of the present invention, and are schematic cross-sectional views showing the relationship between partition walls of the membrane and stoppers formed on a part of the top ring body (carrier)
Figure 13B:
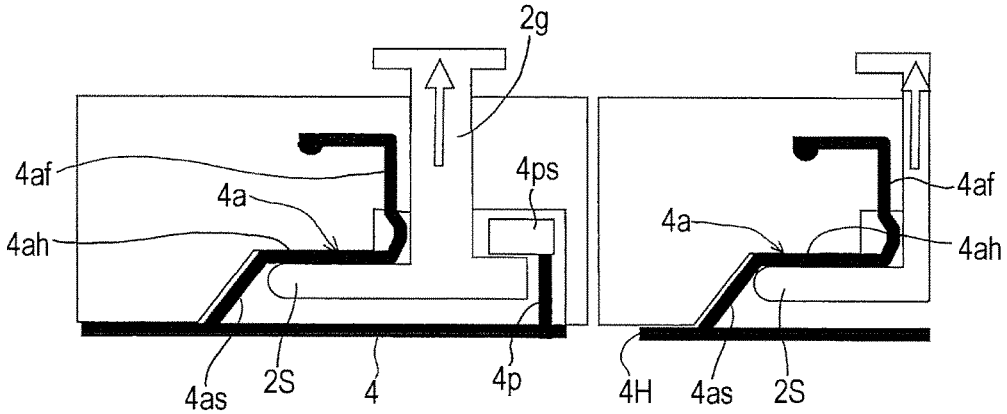

FIG. 13A and FIG. 13B are views showing an eighth embodiment of the present invention, and are schematic cross-sectional views showing the relationship between the partition walls 4*a* of the membrane 4 and movable stoppers provided on the top ring body (carrier) 2. In the example shown in FIGS. 13A and 13B, stoppers 2S capable of being brought into contact with the horizontal portions 4*ah* of the partition walls 4*a* are vertically movable by a vertical movement mechanism (not shown) such as an actuator. Specifically, as shown in FIG. 13A, each of the stoppers 2S has a guide portion 2*g* capable of being fitted with and guided by the top ring body 2. As shown in FIG. 13A, during polishing of the substrate, the stopper 2S is lowered to keep the clearance ranging from 0.5 to 3.0 mm between the horizontal portion 4*ah* of the partition wall 4*a* and the stopper 2S. During substrate release (removal), the stopper 2S is lifted by actuating the vertical movement mechanism as shown in FIG. 13B, thereby further limiting the range of vertical movement of the horizontal portion 4*ah* of the partition wall 4*a*. According to the present embodiment, the range of vertical movement of the partition wall 4*a* of the membrane 4 during substrate release is further limited as compared to the embodiment of FIG. 5, and the amount of inflation is further limited. Therefore, the stress applied to the substrate W during substrate release can be reduced dramatically.

Figure 14:
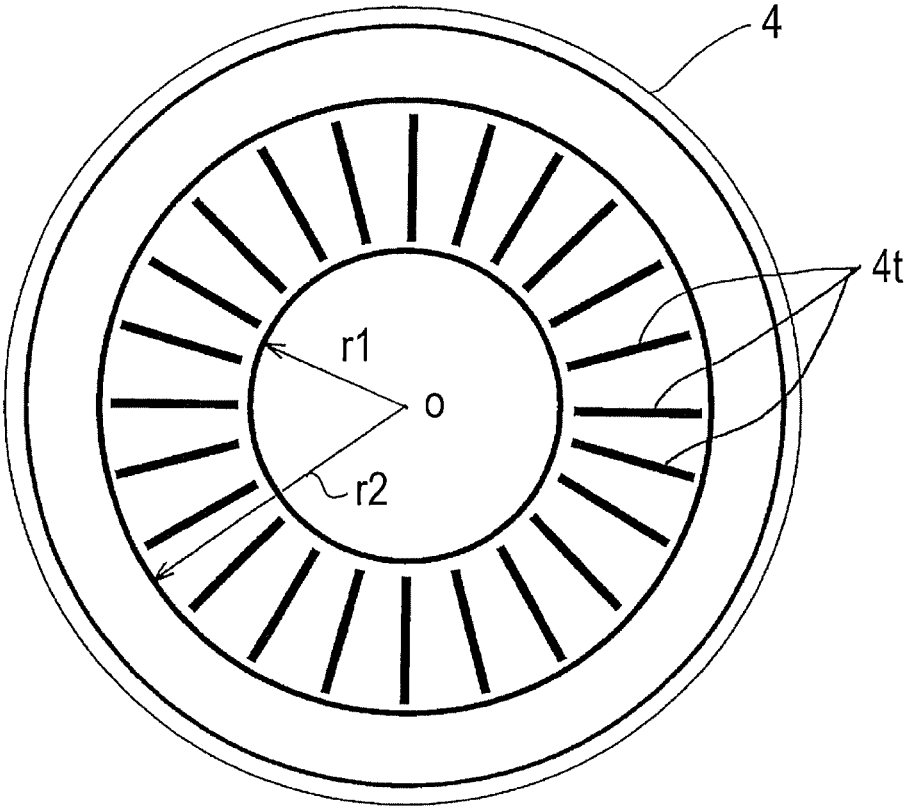
FIG. 14 is a view showing a ninth embodiment of the present invention, and is a plan view showing the rear surface of the membrane whose surface serves as a substrate holding surface.

FIG. 14 is a view showing a ninth embodiment of the present invention, and is a plan view showing the rear surface of the membrane whose surface serves as a substrate holding surface. As shown in FIG. 14, on the rear surface of the membrane 4, a number of projections 4*t* are formed. The projections 4*t* extend radially from the location which is spaced by r1 from the center O of the membrane 4 to the location which is spaced by r2 from the center O of the membrane 4. The area where the projections 4*t* are formed corresponds to one of the pressure chambers, e.g., the ripple chamber 6. With the radial projections 4*t*, the rear surface of the membrane 4 has an increased rigidity, and the amount of inflation of the pressure chamber is limited during substrate release.

Next, a specific structure of a top ring 1 which is suitably used in the present invention will be described below in detail. FIGS. 15 through 19 are cross-sectional views showing the top ring 1 along a plurality of radial directions of the top ring 1.

Figure 15:
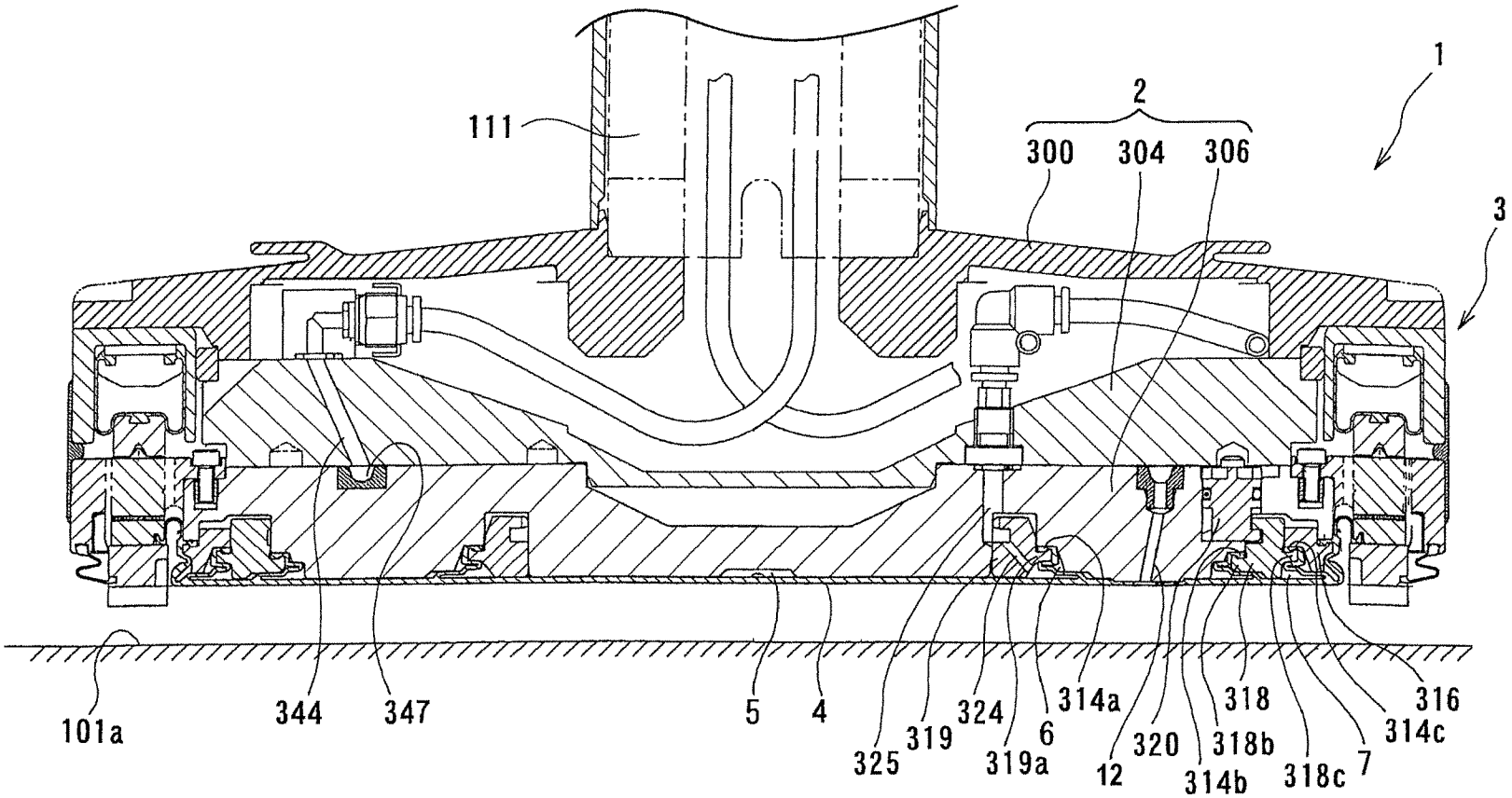
FIG. 15 is a cross-sectional view showing the top ring shown in FIG. 1 in more detail.
Figure 16:
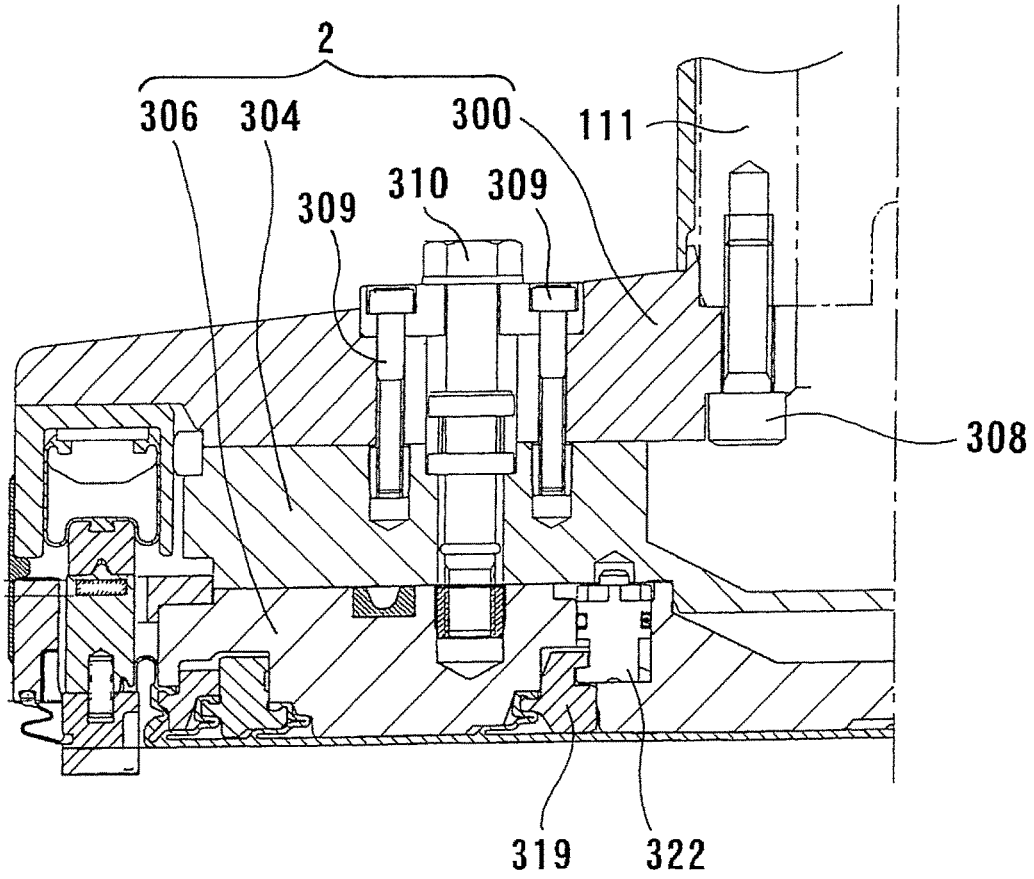
FIG. 16 is a cross-sectional view showing the top ring shown in FIG. 1 in more detail.

FIGS. 15 through 19 are views showing the top ring 1 shown in FIG. 2 in more detail. As shown in FIGS. 15 through 19, the top ring 1 basically comprises a top ring body 2 for pressing a substrate such as a semiconductor substrate W against the polishing surface 101*a*, and a retainer ring 3 for directly pressing the polishing surface 101*a*. The top ring body 2 includes an upper member 300 in the form of a circular plate, an intermediate member 304 attached to a lower surface of the upper member 300, and a lower member 306 attached to a lower surface of the intermediate member 304. The retainer ring 3 is attached to a peripheral portion of the upper member 300 of the top ring body 2. As shown in FIG. 16, the upper member 300 is connected to the top ring shaft 111 by bolts 308. Further, the intermediate member 304 is fixed to the upper member 300 by bolts 309, and the lower member 306 is fixed to the upper member 300 by bolts 310. The top ring body 2 comprising the upper member 300, the intermediate member 304, and the lower member 306 is made of resin such as engineering plastics (e.g. PEEK). The upper member 300 may be made of metal such as SUS or aluminium.

As shown in FIG. 15, the top ring 1 has an elastic membrane 4 attached to a lower surface of the lower member 306. The membrane (elastic membrane) 4 is brought into contact with a rear face of a substrate such as a semiconductor substrate held by the top ring 1. The membrane 4 is held on the lower surface of the lower member 306 by an annular edge holder 316 disposed radially outward and annular ripple holders 318 and 319 disposed radially inward of the edge holder 316. The membrane 4 is made of a highly strong and durable rubber material such as ethylene propylene rubber (EPDM), polyurethane rubber, silicone rubber, or the like.

The edge holder 316 is held by the ripple holder 318, and the ripple holder 318 is held on the lower surface of the lower member 306 by a plurality of stoppers 320. As shown in FIG. 16, the ripple holder 319 is held on the lower surface of the lower member 306 by a plurality of stoppers 322. The stoppers 320 and the stoppers 322 are arranged along a circumferential direction of the top ring 1 at equal intervals.

As shown in FIG. 15, a central chamber 5 is formed at a central portion of the membrane 4. The ripple holder 319 has a passage 324 communicating with the central chamber 5. The lower member 306 has a passage 325 communicating with the passage 324. The passage 324 of the ripple holder 319 and the passage 325 of the lower member 306 are connected to a fluid supply source (not shown). Thus, a pressurized fluid is supplied through the passages 325 and 324 to the central chamber 5 formed by the membrane 4.

The ripple holder 318 has a claw 318*b* for pressing a ripple 314*b* of the membrane 4 against the lower surface of the lower member 306. The ripple holder 319 has a claw 319*a* for pressing a ripple 314*a* of the membrane 4 against the lower surface of the lower member 306. An edge 314*c* of the membrane 4 is pressed by a claw 318*c* of the ripple holder 318 against the edge holder 316.

Figure 17:
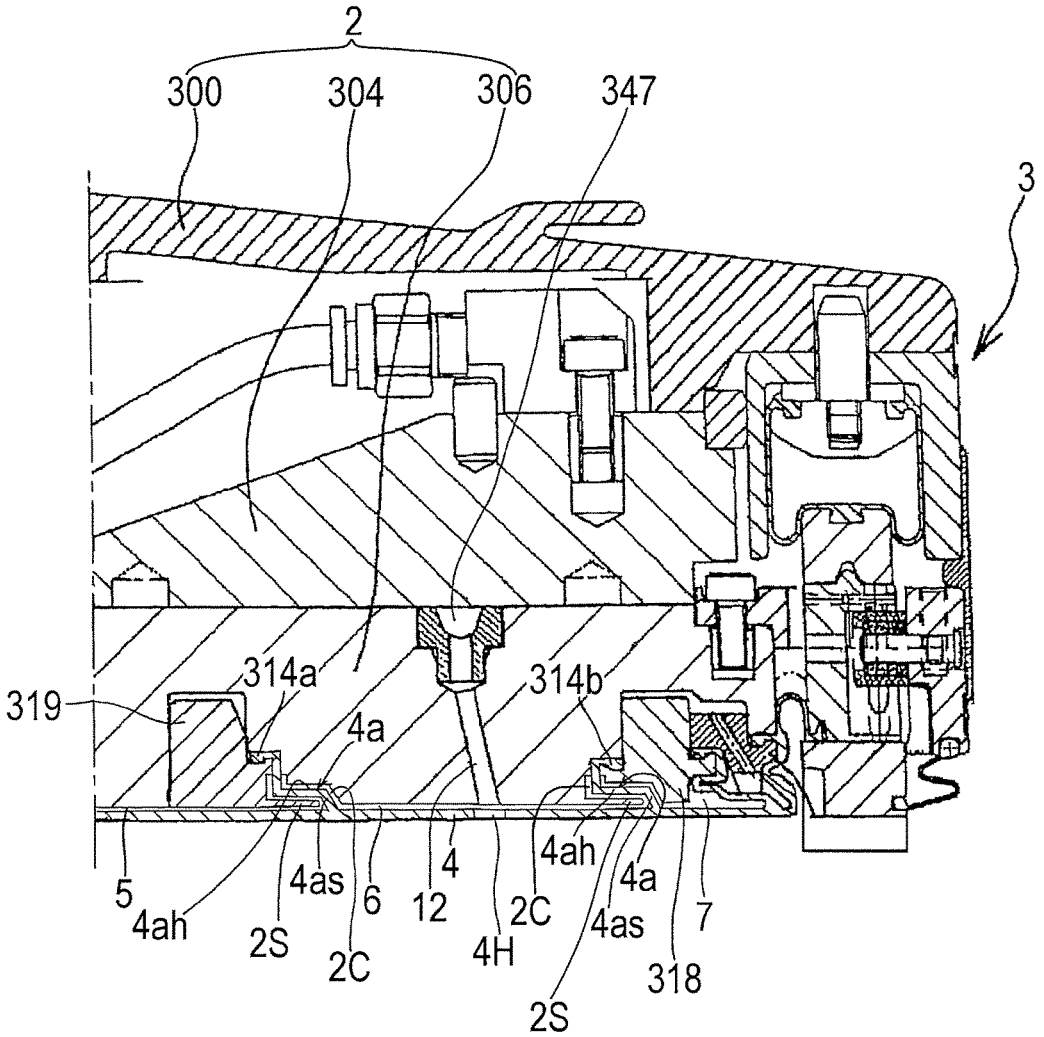
FIG. 17 is a cross-sectional view showing the top ring shown in FIG. 1 in more detail.

As shown in FIG. 17, an annular ripple chamber 6 is formed between the ripple 314*a* and the ripple 314*b* of the membrane 4. The lower member 306 of the top ring body 2 has a passage 12 communicating with the ripple chamber 6. Further, as shown in FIG. 15, the intermediate member 304 has a passage 344 communicating with the passage 12 of the lower member 306. An annular groove 347 is formed at a connecting portion between the passage 12 of the lower member 306 and the passage 344 of the intermediate member 304. The passage 12 of the lower member 306 is connected via the annular groove 347 and the passage 344 of the intermediate member 304 to a fluid supply source (not shown). Thus, a pressurized fluid is supplied through the passages to the ripple chamber 6. An opening 4H is formed in the membrane 4 so as to face the passage 12. Further, the passage 12 is selectively connected to a vacuum source (not shown). A substrate is attached to the lower surface of the membrane 4 by the vacuum source.

As shown in FIG. 17, the right and left partition walls 4*a*, 4*a* for connecting the ripples 314*a*, 314*b* and the rear surface of the membrane 4 whose surface serves as a substrate holding surface, have inclined portions 4*as*, 4*as* extending obliquely upward from the rear surface of the membrane whose surface serves as a substrate holding surface, and horizontal portions 4*ah*, 4*ah* extending horizontally from the inclined portions 4*as*, 4*as*. On the other hand, the lower member 306 of the top ring body 2 has, on its lower end, cavities 2C, 2C for housing the right and left partition walls 4*a*, 4*a*. At the cavities 2C, 2C, there are provided stoppers 2S, 2S which have substantially the same length as the whole length of the horizontal portions 4*ah*, 4*ah* of the partition walls 4*a*, 4*a*. One stopper (right side stopper) 2S is formed on the lower member 306 of the top ring body, and the other stopper (left side stopper) 2S is formed on the ripple holder 319. Each of the stoppers 2S, 2S is positioned below the horizontal portion 4*ah* of the partition wall 4*a*. With this arrangement, the range of vertical movement of the partition wall 4*a* is limited effectively, and thus the amount of inflation of the membrane 4 is limited in the case where the membrane 4 is pressurized in such a state that the surface of the membrane 4 for pressing the substrate is freely expandable, as in the case of removal of the substrate. A clearance ranging from 0.5 to 3.0 mm is provided between the horizontal portion 4*ah* of the partition wall 4*a* and the stopper 2S. By this clearance, the partition wall 4*a* can follow the substrate W during polishing, even if the distance from the mounting position of the partition wall of the membrane to the polishing pad varies in the case where the thickness of consumable parts such as a polishing pad or a retainer ring varies, or the polishing parameters are changed.

Figure 18:
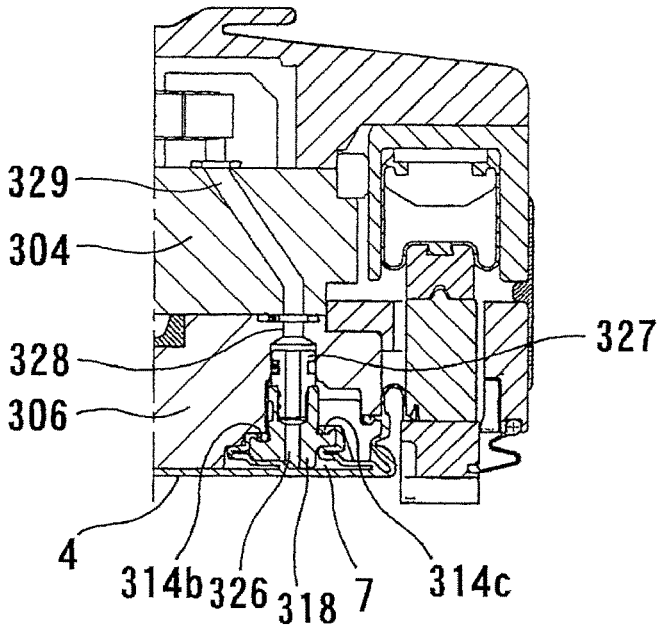
FIG. 18 is a cross-sectional view showing the top ring shown in FIG. 1 in more detail.

As shown in FIG. 18, the ripple holder 318 has a passage 326 communicating with an annular outer chamber 7 formed by the ripple 314*b* and the edge 314*c* of the membrane 4. Further, the lower member 306 has a passage 328 communicating with the passage 326 of the ripple holder 318 via a connector 327. The intermediate member 304 has a passage 329 communicating with the passage 328 of the lower member 306. The passage 326 of the ripple holder 318 is connected via the passage 328 of the lower member 306 and the passage 329 of the intermediate member 304 to a fluid supply source. Thus, a pressurized fluid is supplied through the passages 329, 328, and 326 to the outer chamber 7 formed by the membrane 4. The stoppers 2S are not shown in FIG. 18.

Figure 19:
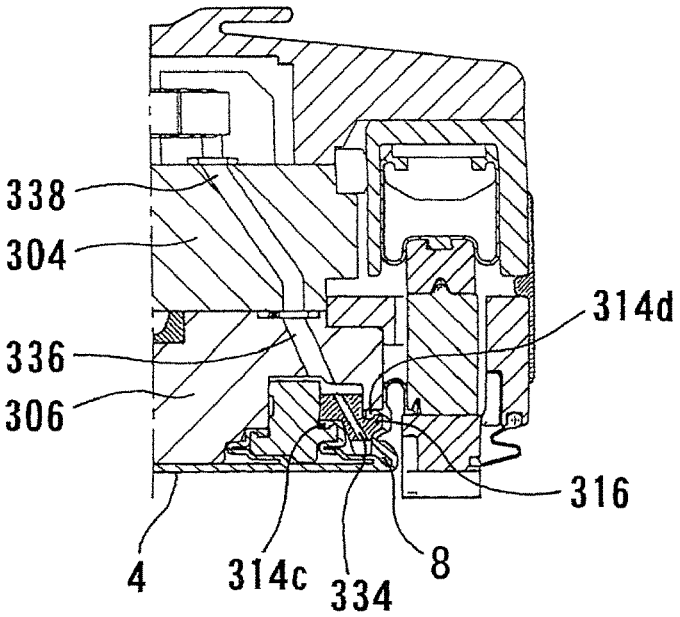
FIG. 19 is a cross-sectional view showing the top ring shown in FIG. 1 in more detail.

As shown in FIG. 19, the edge holder 316 has a claw for holding an edge 314*d* of the membrane 4 on the lower surface of the lower member 306. The edge holder 316 has a passage 334 communicating with an annular edge chamber 8 formed by the edges 314*c* and 314*d* of the membrane 4. The lower member 306 has a passage 336 communicating with the passage 334 of the edge holder 316. The intermediate member 304 has a passage 338 communicating with the passage 336 of the lower member 306. The passage 334 of the edge holder 316 is connected via the passage 336 of the lower member 306 and the passage 338 of the intermediate member 304 to a fluid supply source. Thus, a pressurized fluid is supplied through these passages to the edge chamber 8 formed by the membrane 4. The stoppers 2S are not shown in FIG. 19. The central chamber 5, the ripple chamber 6, the outer chamber 7, the edge chamber 8 and the retainer chamber 9 are connected via the pressure regulators R1-R5 (not shown) and the valves V1-1-V1-3, V2-1-V2-3, V3-1-V3-3, V4-1-V4-3, and V5-1-V5-3 (not shown) to the fluid supply source in the same manner as the embodiment shown in FIG. 2.

As described above, according to the top ring 1 in the present embodiment, pressing forces for pressing a substrate such as a semiconductor substrate against the polishing pad 101 can be adjusted at local areas of the substrate by adjusting pressures of fluids to be supplied to the respective pressure chambers (i.e. the central chamber 5, the ripple chamber 6, the outer chamber 7, and the edge chamber 8) formed between the membrane 4 and the lower member 306.

Figure 20:
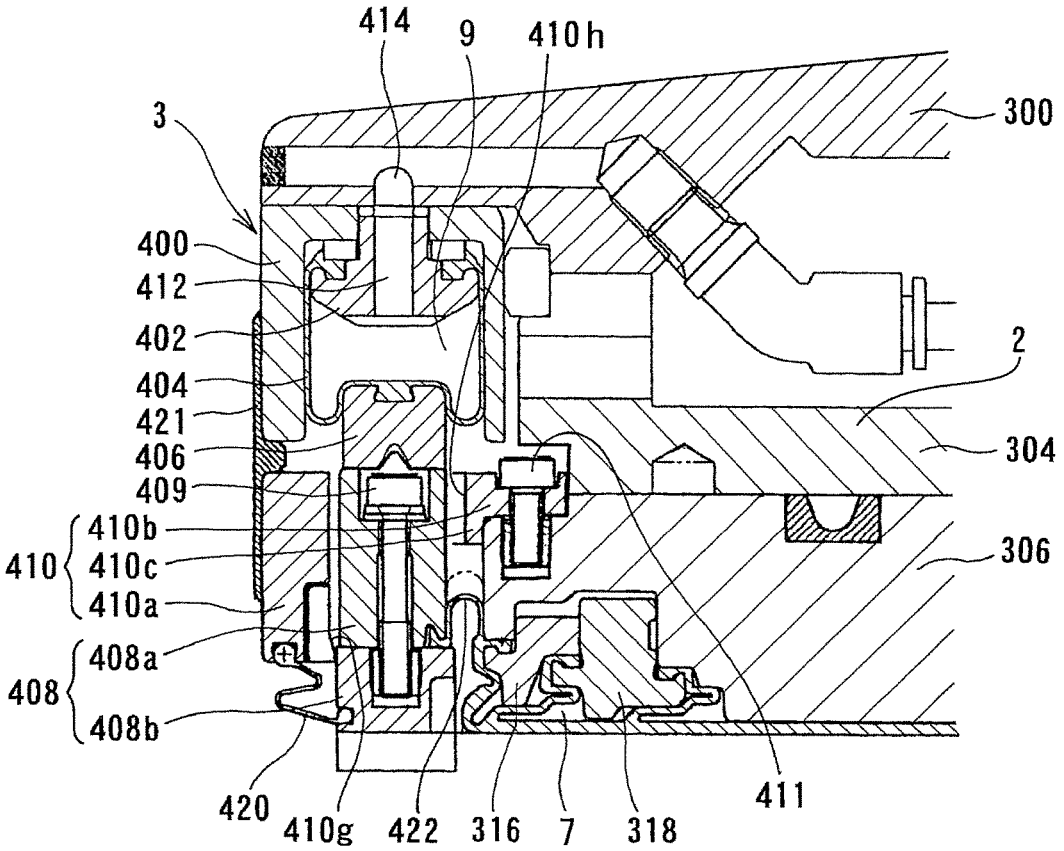
FIG. 20 is an enlarged view of a retainer ring and its peripheral part.

FIG. 20 is an enlarged view of the retainer ring and its peripheral part. The retainer ring 3 serves to hold a peripheral edge of a substrate such as a semiconductor substrate. As shown in FIG. 20, the retainer ring 3 has a cylinder 400 having a cylindrical shape and a closed upper end, a holder 402 attached to an upper portion of the cylinder 400, an elastic membrane 404 held in the cylinder 400 by the holder 402, a piston 406 connected to a lower end of the elastic membrane 404, and a ring member 408 which is pressed downward by the piston 406.

The ring member 408 comprises an upper ring member 408*a* coupled to the piston 406, and a lower ring member 408*b* which is brought into contact with the polishing surface 101*a*. The upper ring member 408*a* and the lower ring member 408*b* are coupled by a plurality of bolts 409. The upper ring member 408*a* is composed of a metal such as SUS or a material such as ceramics. The lower ring member 408*b* is composed of a resin material such as PEEK or PPS.

As shown in FIG. 20, the holder 402 has a passage 412 communicating with the retainer ring chamber 9 formed by the elastic membrane 404. The upper member 300 has a passage 414 communicating with the passage 412 of the holder 402. The passage 412 of the holder 402 is connected via the passage 414 of the upper member 300 to a fluid supply source (not shown). Thus, a pressurized fluid is supplied through the passages 414 and 412 to the retainer ring chamber 9. Accordingly, by adjusting a pressure of a fluid to be supplied to the retainer ring chamber 9, the elastic membrane 404 can be expanded and contracted so as to vertically move the piston 406. Thus, the ring member 408 of the retainer ring 3 can be pressed against the polishing pad 101 under a desired pressure.

In the illustrated example, the elastic membrane 404 employs a rolling diaphragm formed by an elastic membrane having bent portions. When an inner pressure in a chamber defined by the rolling diaphragm is changed, the bent portions of the rolling diaphragm are rolled so as to widen the chamber. The diaphragm is not brought into sliding contact with outside components and is hardly expanded and contracted when the chamber is widened. Accordingly, friction due to sliding contact can extremely be reduced, and a lifetime of the diaphragm can be prolonged. Further, pressing forces under which the retainer ring 3 presses the polishing pad 101 can accurately be adjusted.

With the above arrangement, only the ring member 408 of the retainer ring 3 can be lowered. Accordingly, a pressing force of the retainer ring 3 can be maintained at a constant level by widening the space of the chamber 9 formed by the rolling diaphragm comprising an extremely low friction material, without changing the distance between the lower member 306 and the polishing pad 101 even if the ring member 408 of the retainer ring 3 is worn out. Further, since the ring member 408, which is brought into contact with the polishing pad 101, and the cylinder 400 are connected by the deformable elastic membrane 404, no bending moment is produced by offset loads. Accordingly, surface pressures by the retainer ring 3 can be made uniform, and the retainer ring 3 becomes more likely to follow the polishing pad 101.

Further, as shown in FIG. 20, the retainer ring 3 has a ring-shaped retainer ring guide 410 for guiding vertical movement of the ring member 408. The ring-shaped retainer ring guide 410 comprises an outer peripheral portion 410*a* located at an outer circumferential side of the ring member 408 so as to surround an entire circumference of an upper portion of the ring member 408, an inner peripheral portion 410*b* located at an inner circumferential side of the ring member 408, and an intermediate portion 410*c* configured to connect the outer peripheral portion 410*a* and the inner peripheral portion 410*b*. The inner peripheral portion 410*b* of the retainer ring guide 410 is fixed to the lower member 306 of the top ring body 2 by a plurality of bolts 411. The intermediate portion 410*c* configured to connect the outer peripheral portion 410*a* and the inner peripheral portion 410*b* has a plurality of openings 410*h* which are formed at equal intervals in a circumferential direction of the intermediate portion 410*c*. The stoppers 2S are not shown in FIG. 20.

As shown in FIGS. 15 through 20, a connection sheet 420, which can be expanded and contracted in a vertical direction, is provided between an outer circumferential surface of the ring member 408 and a lower end of the retainer ring guide 410. The connection sheet 420 is disposed so as to fill a gap between the ring member 408 and the retainer ring guide 410. Thus, the connection sheet 420 serves to prevent a polishing liquid (slurry) from being introduced into the gap between the ring member 408 and the retainer ring guide 410. A band 421 comprising a belt-like flexible member is provided between an outer circumferential surface of the cylinder 400 and an outer circumferential surface of the retainer ring guide 410. The band 421 is disposed so as to cover a gap between the cylinder 400 and the retainer ring guide 410. Thus, the band 421 serves to prevent a polishing liquid (slurry) from being introduced into the gap between the cylinder 400 and the retainer ring guide 410.

The membrane 4 includes a seal portion 422 connecting the membrane 4 to the retainer ring 3 at an edge (periphery) 314*d* (shown in FIG. 19) of the membrane 4. The seal portion 422 has an upwardly curved shape. The seal portion 422 is disposed so as to fill a gap between the membrane 4 and the ring member 408. The seal portion 422 is made of a deformable material. The seal portion 422 serves to prevent a polishing liquid from being introduced into the gap between the membrane 4 and the retainer ring 3 while allowing the top ring body 2 and the retainer ring 3 to be moved relative to each other. In the present embodiment, the seal portion 422 is formed integrally with the edge 314*d* of the membrane 4 and has a U-shaped cross-section.

If the connection sheet 420, the band 421 and the seal portion 422 are not provided, a polishing liquid may be introduced into an interior of the top ring 1 so as to inhibit normal operation of the top ring body 2 and the retainer ring 3 of the top ring 1. In the present embodiment, the connection sheet 420, the band 421 and the seal portion 422 prevent a polishing liquid from being introduced into the interior of the top ring 1. Accordingly, it is possible to operate the top ring 1 normally. The elastic membrane 404, the connection sheet 420, and the seal portion 422 are made of a highly strong and durable rubber material such as ethylene propylene rubber (EPDM), polyurethane rubber, silicone rubber, or the like.

Although certain preferred embodiments of the present invention have been shown and described in detail, it should be understood that various changes and modifications may be made therein without departing from the scope of the appended claims.

What is claimed is:

1. A substrate holding apparatus for holding a substrate to be polished and pressing the substrate against a polishing surface, comprising;

an elastic membrane;

a top ring body for holding said elastic membrane;

a plurality of pressure chambers partitioned by at least one partition wall of said elastic membrane between said elastic membrane and a lower surface of said top ring body, the substrate being held by a lower surface of said elastic membrane and being pressed against the polishing surface with a fluid pressure by supplying a pressurized fluid to said plurality of pressure chambers; and a stopper configured to limit the inflation of said elastic membrane by being brought into contact with a part of said partition wall of said elastic membrane, when the pressurized fluid is supplied to at least one of said pressure chambers in a state that the substrate held by said elastic membrane is not brought into contact with the polishing surface, wherein said partition wall of said elastic membrane comprises a fixing portion configured to be fixed to said top ring body and to extend vertically, a horizontal portion configured to extend horizontally from said fixing portion, and a portion configured to extend from said horizontal portion and to be connected to a rear surface of said elastic membrane whose lower surface serves as a substrate holding surface;

wherein said stopper horizontally projects inwardly from said top ring body and is located between said horizontal portion of said partition wall and said rear surface of said elastic membrane; and a horizontal surface of said stopper is configured to limit the inflation of said elastic membrane by being brought into contact with said horizontal portion of said partition wall.

2. A substrate holding apparatus according to claim 1, wherein said stopper is disposed below said horizontal portion of said partition wall.

3. A substrate holding apparatus according to claim 1, wherein there is a predetermined clearance between said stopper, and said horizontal portion of said partition wall.

4. A substrate holding apparatus according to claim 3, wherein said predetermined clearance is in the range of 0.5 to 3.0 mm.

5. A substrate holding apparatus according to claim 1, wherein said stopper comprises a horizontal portion extending horizontally at a lower part of said top ring body.

6. A substrate holding apparatus according to claim 5, wherein said horizontal portion of said stopper is substantially the same length as said horizontal portion of said partition wall.

7. A substrate holding apparatus according to claim 1, wherein a tip corner of said stopper is chamfered.

8. A substrate holding apparatus according to claim 1, wherein at least one of said stopper and said partition wall has a surface treatment.

9. A substrate holding apparatus according to claim 1, wherein at least one projection is formed on the rear surface of said substrate holding surface of said elastic membrane.

10. A substrate holding apparatus according to claim 1, wherein an opening for ejecting the pressurized fluid toward the substrate, is formed in said elastic membrane for defining said at least one pressure chamber.

11. A substrate holding apparatus according to claim 1, wherein said at least one pressure chamber is coupled to the pressurized fluid.

12. A substrate holding apparatus according to claim 1, further comprising:

a polishing table having a polishing surface; and a substrate transfer unit configured to transfer the substrate between said substrate holding apparatus and said substrate transfer unit.

13. A substrate holding apparatus according to claim 1, wherein the elastic membrane comprises an opening in a surface of the elastic membrane that faces the substrate.

14. A substrate holding apparatus according to claim 1, wherein the stopper is configured to impinge upon the horizontal portion of the elastic membrane during an operation to release the substrate from the substrate holding apparatus.

15. A substrate holding apparatus according to claim 1, wherein a first surface of the horizontal portion of the elastic membrane contacts a surface of the stopper caused by pressure applied to a second surface of the horizontal portion to allow the horizontal portion of the elastic membrane to remain substantially horizontal by the contact with the stopper, the second surface being opposite the first surface.

16. A substrate holding apparatus according to claim 1, further comprising the horizontal portion joined to the vertically extending portion wherein the horizontal portion of the fixing portion of said partition wall of said elastic membrane and said stopper are on different horizontal lines and wherein the vertically extending portion extends from the horizontal portion towards the substrate.

17. A substrate holding apparatus for holding a substrate to be polished and pressing the substrate against a polishing surface, comprising;

an elastic membrane;

a top ring body for holding said elastic membrane;

a plurality of pressure chambers partitioned by at least one partition wall of said elastic membrane between said elastic membrane and a lower surface of said top ring body, the substrate being held by a lower surface of said elastic membrane and being pressed against the polishing surface with a fluid pressure by supplying a pressurized fluid to said plurality of pressure chambers; and a stopper configured to limit the inflation of said elastic membrane by being brought into contact with an extending member provided separately from said partition wall and extending from a rear surface of said elastic membrane whose lower surface serves as a substrate holding surface, when the pressurized fluid is supplied to at least one of said pressure chambers in a state that the substrate held by said elastic membrane is not brought into contact with the polishing surface;

wherein said extending member has a tip end located between said top ring body and said stopper, wherein said stopper horizontally projects inwardly from said top ring body; and a horizontal surface of said stopper is configured to limit the inflation of said elastic membrane by being brought into contact with said tip end of said extending member.

18. A substrate holding apparatus according to claim 17, having a predetermined clearance between said stopper and said extending member.

19. A substrate holding apparatus according to claim 17, wherein said predetermined clearance is in the range of 0.5 to 3.0 mm.

20. A substrate holding apparatus according to claim 17, wherein a tip corner of said stopper is chamfered.

21. A substrate holding apparatus according to claim 17, wherein said tip end of said extending member is a horizontal portion on an upper part of said extending member, said horizontal portion of said extending member being configured to be brought into contact with said stopper.

22. A substrate holding apparatus according to claim 17, wherein said extending member comprises an annular rib or a plurality of support members.

23. A substrate holding apparatus according to claim 17, wherein said stopper is configured to be vertically movable by a vertical movement mechanism.

24. A substrate holding apparatus according to claim 17, wherein at least one of said stopper and said extending member is configured to receive surface treatment.

25. A substrate holding apparatus according to claim 17, wherein at least one projection is formed on the rear surface of said substrate holding surface of said elastic membrane.

26. A substrate holding apparatus according to claim 17, wherein an opening for ejecting the pressurized fluid toward the substrate, is formed in said elastic membrane for defining said at least one pressure chamber.

27. A substrate holding apparatus according to claim 17, wherein said at least one pressure chamber is coupled to the pressurized fluid supply.

28. A substrate holding apparatus according to claim 17, further comprising:

a polishing table having a polishing surface; and a substrate transfer unit configured to transfer the substrate between said substrate holding apparatus and said substrate transfer unit.

29. A substrate holding apparatus for holding a substrate to be polished and pressing the substrate against a polishing surface, comprising;

an elastic membrane;

a top ring body for holding said elastic membrane;

a plurality of pressure chambers partitioned by at least one partition wall of said elastic membrane between said elastic membrane and a lower surface of said top ring body, the substrate being held by a lower surface of said elastic membrane and being pressed against the polishing surface with a fluid pressure by supplying a pressurized fluid to said plurality of pressure chambers; and a stopper configured to horizontally project inwardly from said top ring body and limit the inflation of said elastic membrane by being brought into contact with an extending member provided separately from said partition wall and extending from a rear surface of said elastic membrane whose lower surface serves as a substrate holding surface, when the pressurized fluid is supplied to at least one of said pressure chambers in a state that the substrate held by said elastic membrane is not brought into contact with the polishing surface;

wherein said extending member passes through said top ring body and extends upward, and said extending member has a tip end located above an upper surface of said top ring body; and a horizontal surface of said stopper is configured to limit the inflation of said elastic membrane by being brought into contact with said tip end of said extending member.

* * * * *